US010474051B2

(12) United States Patent
Takii et al.

(10) Patent No.: US 10,474,051 B2
(45) Date of Patent: Nov. 12, 2019

(54) CARRIER FOR DEVELOPER OF ELECTROSTATIC LATENT IMAGE, TWO-COMPONENT DEVELOPER, REPLENISHING DEVELOPER, IMAGE FORMING APPARATUS, AND TONER STORED UNIT

(71) Applicants: Mariko Takii, Kanagawa (JP); Koichi Sakata, Shizuoka (JP); Tohru Suganuma, Shizuoka (JP); Masahiro Seki, Shizuoka (JP); Masashi Nagayama, Shizuoka (JP); Shinya Nakagawa, Shizuoka (JP); Kei Niwayama, Shizuoka (JP)

(72) Inventors: Mariko Takii, Kanagawa (JP); Koichi Sakata, Shizuoka (JP); Tohru Suganuma, Shizuoka (JP); Masahiro Seki, Shizuoka (JP); Masashi Nagayama, Shizuoka (JP); Shinya Nakagawa, Shizuoka (JP); Kei Niwayama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/131,566

(22) Filed: Sep. 14, 2018

(65) Prior Publication Data

US 2019/0018331 A1 Jan. 17, 2019

Related U.S. Application Data

(63) Continuation of application No. PCT/JP2017/007610, filed on Feb. 28, 2017.

(30) Foreign Application Priority Data

Mar. 17, 2016 (JP) ..... 2016-053684

(51) Int. Cl.
*G03G 9/08* (2006.01)
*G03G 9/113* (2006.01)
(Continued)

(52) U.S. Cl.
CPC ..... *G03G 9/1139* (2013.01); *G03G 9/08755* (2013.01); *G03G 9/1075* (2013.01);
(Continued)

(58) Field of Classification Search
CPC ... G03G 9/1075; G03G 9/1139; G03G 9/1133
(Continued)

(56) References Cited

U.S. PATENT DOCUMENTS 5,652,079 A 7/1997 Mochizuki et al.
5,932,388 A 8/1999 Umeno et al.
(Continued)

FOREIGN PATENT DOCUMENTS

JP 07-286078 10/1995
JP 10-142842 5/1998
(Continued)

OTHER PUBLICATIONS

International Search Report dated Apr. 4, 2017 for counterpart International Patent Application No. PCT/JP2017/007610 filed Feb. 28, 2017 ( with English Translation).
(Continued)

*Primary Examiner* — Mark A Chapman
(74) *Attorney, Agent, or Firm* — Oblon, McClelland, Maier & Neustadt, L.L.P.

(57) ABSTRACT

Provided is a carrier for a developer of an electrostatic latent image, the carrier including a core particle, and a resin layer covering the core particle, where the resin layer includes metal compound particles, wherein the metal compound particles include magnesium compound particles or barium compound particles, and an exposed amount B (atomic %)
(Continued)

of the magnesium or the barium on a surface of the carrier particle satisfies a relationship below:

$$10.0 \geq B \geq 1.2.$$

11 Claims, 2 Drawing Sheets

(51) Int. Cl.
*G03G 9/107* (2006.01)
*G03G 9/087* (2006.01)
*G03G 15/08* (2006.01)

(52) U.S. Cl.
CPC ..... *G03G 9/1133* (2013.01); *G03G 9/1136* (2013.01); *G03G 15/0867* (2013.01)

(58) Field of Classification Search
USPC ..... 430/111.35
See application file for complete search history.

(56) References Cited

U.S. PATENT DOCUMENTS 6,051,352 A 4/2000 Umeno et al.
6,319,646 B1 11/2001 Suganuma
7,163,774 B2 1/2007 Shiraishi et al.
7,169,525 B2 1/2007 Sugiura et al.
7,172,844 B2 2/2007 Umemura et al.
7,258,959 B2 8/2007 Nakayama et al.
7,261,989 B2 8/2007 Sugiura et al.
7,318,989 B2 1/2008 Kotsugai et al.
7,374,851 B2 5/2008 Nakayama et al.
7,455,942 B2 11/2008 Nagatomo et al.
7,890,028 B2 2/2011 Miyamoto et al.
8,067,141 B2 11/2011 Yamaguchi et al.
8,431,312 B2 4/2013 Masuda et al.
8,728,698 B2 5/2014 Nagayama et al.
9,261,817 B2 2/2016 Iwatsuki et al.
9,348,259 B2 5/2016 Nagayama et al.
2003/0165759 A1 9/2003 Suzuki et al.
2003/0219670 A1 11/2003 Sawada et al.
2004/0121254 A1 6/2004 Nagayama et al.
2004/0234879 A1 11/2004 Hasegawa et al.
2005/0008961 A1 1/2005 Takada et al.
2005/0026064 A1 2/2005 Sugiura et al.
2005/0089786 A1 4/2005 Sugiura et al.
2005/0089787 A1 4/2005 Uchinokura et al.
2005/0158643 A1 7/2005 Yamaguchi et al.
2005/0158648 A1 7/2005 Makino et al.
2005/0191575 A1 9/2005 Sugiura et al.
2005/0208408 A1 9/2005 Uchinokura et al.
2005/0208411 A1 9/2005 Nakayama et al.
2005/0238982 A1 10/2005 Suzuki et al.
2005/0277046 A1 12/2005 Sawada et al.
2006/0024606 A1 2/2006 Suzuki et al.
2006/0029433 A1 2/2006 Saito et al.
2006/0032952 A1 2/2006 Kawamoto et al.
2006/0057487 A1 3/2006 Nagayama et al.
2006/0127152 A1 6/2006 Nagayama et al.
2006/0210905 A1 9/2006 Imahashi et al.
2006/0222987 A1 10/2006 Suzuki et al.
2007/0048652 A1 3/2007 Imahashi et al.
2007/0190444 A1 8/2007 Kotsugai et al.
2007/0243482 A1 10/2007 Yamaguchi et al.
2007/0275318 A1 11/2007 Sugiura et al.
2008/0014527 A1 1/2008 Kotsugai et al.
2008/0073252 A1 3/2008 Yamaguchi et al.
2008/0096121 A1 4/2008 Iwatsuki et al.
2008/0152393 A1 6/2008 Nagayama et al.
2008/0171274 A1 7/2008 Yagi et al.
2008/0181670 A1 7/2008 Tsuda et al.
2008/0213682 A1 9/2008 Saitoh et al.
2008/0213684 A1 9/2008 Nagayama et al.
2008/0227021 A1 9/2008 Suganuma
2008/0267668 A1 10/2008 Sakata et al.
2008/0268366 A1 10/2008 Nakayama et al.
2008/0317508 A1 12/2008 Terai et al.
2009/0074450 A1 3/2009 Nagayama et al.
2009/0074473 A1 3/2009 Takahashi et al.
2009/0103943 A1 4/2009 Sakata
2009/0142678 A1 6/2009 Yagi et al.
2009/0232526 A1 9/2009 Yoneda et al.
2009/0232532 A1 9/2009 Sakata et al.
2010/0068645 A1 3/2010 Iwatsuki et al.
2010/0233613 A1 9/2010 Masuda et al.
2010/0239975 A1 9/2010 Yamaguchi et al.
2011/0058831 A1 3/2011 Usami et al.
2011/0065037 A1 3/2011 Iwatsuki et al.
2011/0086307 A1 4/2011 Nakajima et al.
2011/0091802 A1 4/2011 Takahashi et al.
2011/0171573 A1 7/2011 Sakata et al.
2011/0229817 A1 9/2011 Yamada et al.
2011/0305485 A1 12/2011 Oshikawa et al.
2012/0009514 A1 1/2012 Nagayama et al.
2012/0009518 A1 1/2012 Nagayama et al.
2012/0028183 A1 2/2012 Nakajima et al.
2012/0057898 A1 3/2012 Sakata et al.
2012/0058423 A1 3/2012 Yamaguchi et al.
2012/0064451 A1 3/2012 Kishida et al.
2012/0230725 A1 9/2012 Sakata et al.
2012/0237868 A1 9/2012 Yamada et al.
2012/0251168 A1 10/2012 Nagayama et al.
2012/0251169 A1 10/2012 Aoki et al.
2012/0328976 A1 12/2012 Seki et al.
2013/0004209 A1 1/2013 Kishida et al.
2013/0016999 A1 1/2013 Tohmatsu et al.
2013/0065175 A1 3/2013 Sakata et al.
2013/0244157 A1 9/2013 Inoue et al.
2013/0244162 A1 9/2013 Yamada et al.
2013/0252160 A1 9/2013 Nagayama et al.
2013/0252169 A1 9/2013 Yaguchi et al.
2013/0260299 A1 10/2013 Nakajima et al.
2013/0260302 A1 10/2013 Nakajima et al.
2013/0260307 A1 10/2013 Nagayama et al.
2014/0072910 A1 3/2014 Iwatsuki et al.
2014/0080052 A1 3/2014 Yaguchi et al.
2014/0227638 A1 8/2014 Kishida et al.
2014/0248557 A1 9/2014 Yaguchi et al.
2014/0255840 A1 9/2014 Sekiguchi et al.
2015/0030819 A1 1/2015 Naito et al.
2015/0153665 A1 6/2015 Kishida et al.
2015/0248074 A1 9/2015 Suzuki et al.
2015/0253685 A1 9/2015 Suzuki et al.
2016/0327884 A1 11/2016 Nakajima et al.
2016/0363880 A1 12/2016 Takii et al.
2017/0153563 A1 6/2017 Kishida et al.
2018/0120724 A1 5/2018 Sakata et al.
2018/0267421 A1* 9/2018 Takii ..... G03G 9/1075

FOREIGN PATENT DOCUMENTS

JP 10-339973 12/1998
JP 11-084740 3/1999
JP 11-184167 7/1999
JP 11-202560 7/1999
JP 2000-098666 4/2000
JP 3429219 5/2003
JP 2006-039357 2/2006
JP 2009-069500 4/2009
JP 2010-117519 5/2010
JP 2010-169840 8/2010
JP 2011-145397 7/2011
JP 2011-209678 10/2011
JP 2012-047971 3/2012
JP 2012-048167 3/2012
JP 2012-053421 3/2012
JP 2012-083389 4/2012
JP 2016-212254 12/2016

(56) References Cited

OTHER PUBLICATIONS

Written Opinion dated Apr. 4, 2017 for counterpart International Patent Application No. PCT/JP2017/007610 filed Feb. 28, 2017.

Office Action dated Jun. 11, 2019, in Japanese patent application No. 2018-505782, (w/ English translation) 16 pages.

* cited by examiner

CARRIER FOR DEVELOPER OF ELECTROSTATIC LATENT IMAGE, TWO-COMPONENT DEVELOPER, REPLENISHING DEVELOPER, IMAGE FORMING APPARATUS, AND TONER STORED UNIT

CROSS-REFERENCE TO RELATED APPLICATIONS

The present application is a continuation application of International Application No. PCT/JP2017/007610, filed Feb. 28, 2017, which claims priority to Japanese Patent Application No. 2016-053684, filed Mar. 17, 2016. The contents of these applications are incorporated herein by reference in their entirety.

BACKGROUND OF THE INVENTION

Field of the Invention

The present disclosure relates to a carrier for a developer of an electrostatic latent image, and a two-component developer, a replenishing developer, an image forming apparatus, and a toner stored unit all of which use the carrier.

Description of the Related Art

In the course of image formation in an electrophotographic system, an electrostatic latent image is formed on an electrostatic latent image bearer, such as a photoconductive material, a charged toner is deposited on the electrostatic latent image to form a toner image, and the toner image is then transferred to a recording medium and fixed to form an output image. Recently, a technology related to photocopiers or printers using an electrophotographic system has been rapidly sifted from monochrome image formation to full-color image formation. A market for full-color image formation is expected to expand even more.

A two-component developer used for an electrophotographic system is composed of a toner and a carrier. The carrier is a bearing material that is mixed and stirred with the toner separately supplied inside a developing chamber to impart desired charge to the toner, and to transport the charged toner to an electrostatic latent image on a photoconductor to thereby form a toner image.

As a carrier, a known carrier is a carrier having a resin including carbon black formed on a surface of a carrier as a coating layer for the purpose of preventing filming of a toner, forming a uniform surface, preventing oxidization of the surface, preventing reduction in moisture sensitivity, extending a service life of a developer, preventing deposition on a surface of a photoconductor, protecting a photoconductor from scratches or abrasion, controlling a polarity of charging, and adjusting a charge amount.

Although excellent images can be formed with the above-mentioned carrier, there is a problem that an image quality decreases due to peeling of a coating layer of the carrier, as the number of sheets copied increases. Moreover, there is a problem that color staining occurs because the coating layer is peeled off from the carrier, or carbon black is fallen off from the coating layer. Generally, titanium oxide and zinc oxide are known as alternative materials of carbon black, but such materials demonstrate an insufficient effect of lowering volume resistivity.

Japanese Unexamined Patent Application Publication No. 11-202560 discloses a carrier to which a coating layer containing antimony-doped tin oxide (ATO) as a needle-shaped conductive powder is formed. Japanese Unexamined Patent Application Publication No. 2006-39357 discloses a carrier, in which a coating layer containing conductive particles is formed on a surface of each base particle, where each conductive particle includes a laminate of a tin dioxide layer and an indium oxide layer containing tin dioxide.

Moreover, it has been know that a coating layer including two different types of particles is disposed on a core. For example, Japanese Unexamined Patent Application Publication No. 11-184167 discloses a coated carrier in which a first coating layer disposed just above a core includes a needle-like or scaly conductive powder and a second coating layer disposed above the first coating layer includes a particulate conductive powder. Japanese Unexamined Patent Application Publication No. 07-286078 discloses a carrier, in which a coating layer disposed on a carrier core includes a binder resin, first particles an average particle of which is equal to or larger than a film thickness of the coating layer, and second particles an average particle of which is equal to or smaller than the film thickness of the coating layer, and discloses, as an example that volume resistivity of the second particles is $1.0\times10^{12}\Omega\cdot$cm or less (Claim 1 of Japanese Unexamined Patent Application Publication No. 07-286078), an example (Example 1) of a carrier, in which a coating layer is formed on each ferrite core with a coating liquid including 1,500 parts by mass of alumina particles (volume average particle diameter: 0.35 μm, volume resistivity: $1.0\times10^{14}\Omega\cdot$cm), 6,000 parts by mass of titanium oxide (volume average particle diameter: 0.015 μm, volume resistivity: $1.0\times10^{6}\Omega\cdot$cm), and 1,950 parts by mass of curable acrylic resin (solid content: 50%). Japanese Unexamined Patent Application Publication No. 2006-39357 discloses a technique for adjusting resistance using conductive fillers composed of tin dioxide and indium oxide.

Moreover, Japanese Unexamined Patent Application Publication No. 2010-117519 also discloses a carrier having a coating layer including first conductive particles, in which carbon is disposed on surfaces of tin oxide particles, and second conductive particles, in which surfaces of metal oxide particles and/or metal salt particles are conduction-treated.

Japanese Unexamined Patent Application Publication No. 2012-048167 discloses a carrier having a coating layer including magnetite particles.

Japanese Unexamined Patent Application Publication No. 2012-053421 discloses a carrier having a coating layer including an oxygen-deficient tin oxide-coated barium sulfate powder (product name: Pastran 4310, available from MITSUI MINING & SMELTING CO., LTD.).

SUMMARY OF THE INVENTION

According to one aspect of the present disclosure, a carrier for a developer of an electrostatic latent image includes a core particle and a resin layer covering the core particle, where the resin layer includes metal compound particles. The metal compound particles include magnesium compound particles or barium compound particles, and an exposed amount B (atomic %) of the magnesium or the barium on a surface of the carrier satisfies a relationship below:

$$10.0\geq B\geq 1.2$$

DESCRIPTION OF THE EMBODIMENTS

Figure 1:
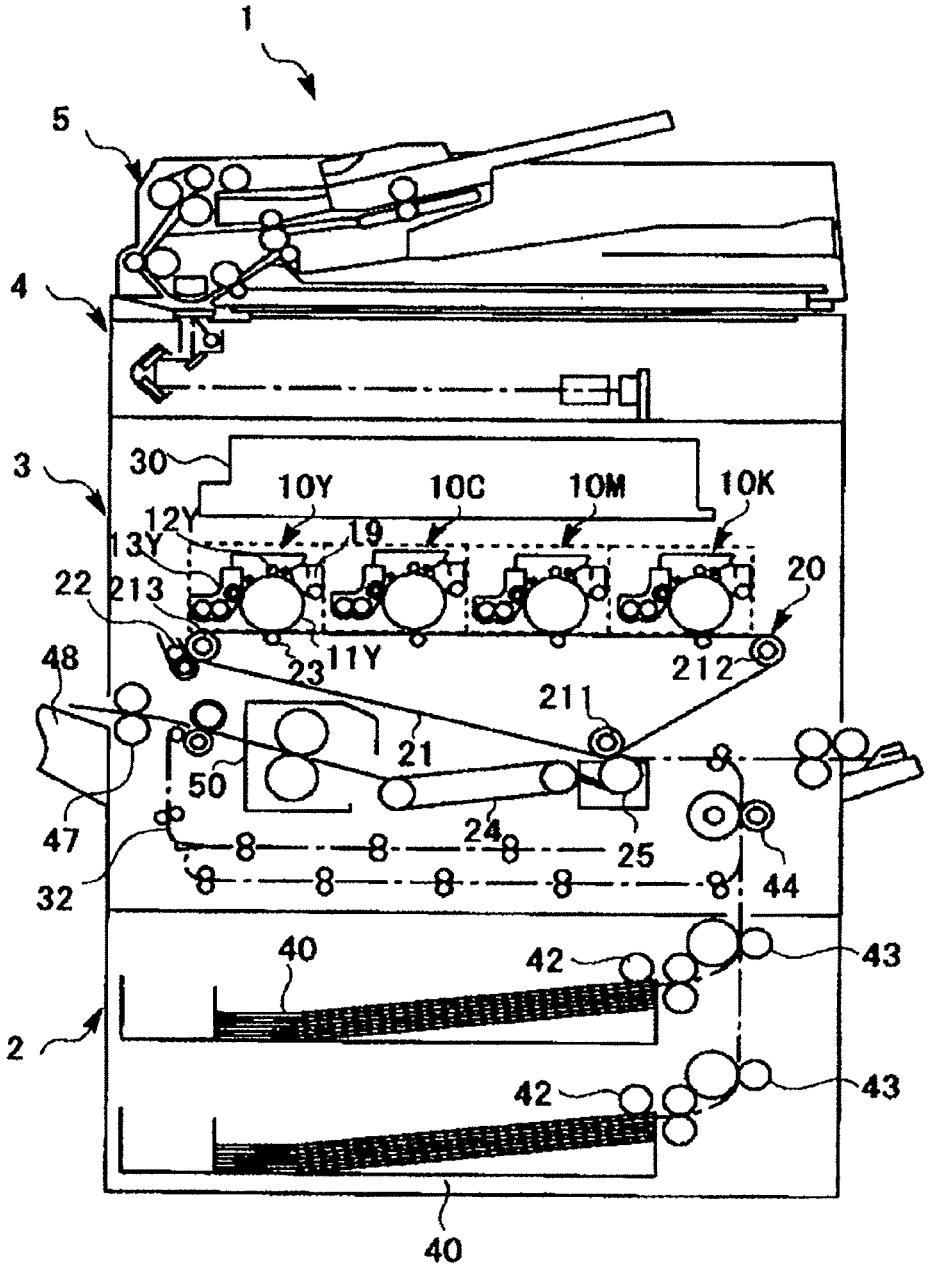
FIG. 1 is a schematic view illustrating one example of an image forming apparatus of the present disclosure.

It is considered that the carrier disclosed in Japanese Unexamined Patent Application Publication No. 2012-048167 may cause scraping of a coat to make carrier deposition worse due to low resistance because an amount of the particles is small relative to a formulated amount of the resin.

The carrier disclosed in Japanese Unexamined Patent Application Publication No. 2012-053421 includes a small amount of the barium particles relative to a formulated amount of the resin and Japanese Unexamined Patent Application Publication No. 2012-053421 does not clearly describe a drying time.

In recent years, a toner tends to be fixed at a low temperature to reduce energy consumption. In addition to it, moreover, printing speed has been increased. Therefore, filming of a toner component to a carrier likely to occur more easily. It is a current trend that a toner includes a large amount of additives and such additives tend to be spent on a carrier, leading to a reduction in a charge amount of the toner and a reduction in margins against toner scattering and background fog.

Meanwhile, even higher image quality is desired in a recently expanding field of production printing. It is technically very difficult to deal with a concentration variation or concentration unevenness within an image on one sheet, or a concentration variation between images printed on some ten thousands sheets only with a body of a machine. Therefore, there is an even stronger need for controlling a charge amount of a toner to be constant. However, the carriers disclosed in the above-mentioned patent literatures cannot satisfy the above-described needs.

There are needs in both a field of production printing and a field of multifunction printers (MFP), which have been widely available in the art, for providing a highly durable device capable of stably outputting images, specifically, a developer and a carrier having both excellent charging ability and durability.

Based on the above-mentioned various technical problems, the present disclosure aims to provide a carrier for a developer of an electrostatic latent image, where the carrier is used for a two-component developer for use in an electrophotographic method or an electrostatic recording method, which can secure sufficient charge control and durability that can respond to image quality and durability desired in the market, can stably supply a developer to a developing region, and can realize continuous output of images of a low imaging area ratio with a high-speed device using a low-temperature fixing toner.

As it can be understood from the detailed and concrete descriptions below, the present disclosure can provide a carrier, which can secure sufficient charge controlling ability and durability that can respond to image quality and durability desired in the market, can provide a developer that can be stably supplied in a developing region, and can realize continuous printing at a printing density of a low imaging area rate performed by a high-speed device using a low-temperature fixing toner.

A carrier of the present disclosure will be specifically described.

The present disclosure relates to (1) below, but embodiments for carrying out the present disclosure also include (2) to (8) below. Therefore, (2) to (8) will be described as well as (1).

(1) A carrier for a developer of an electrostatic latent image, the carrier including:
a core particle; and
a resin layer covering the core particle, where the resin layer includes metal compound particles,
wherein the metal compound particles include magnesium compound particles or barium compound particles, and an exposed amount B (atomic %) of the magnesium or the barium on a surface of the carrier satisfies a relationship below:

$$10.0 \geq B \geq 1.2.$$

(2) The carrier for a developer of an electrostatic latent image according to (1),
wherein the exposed amount B (atomic %) satisfies a relationship below:

$$8.0 \geq B \geq 3.0.$$

(3) The carrier for a developer of an electrostatic latent image according to (1) or (2),
wherein the metal compound particles are the barium compound particles.

(4) The carrier for a developer of an electrostatic latent image according to any one of (1) to (3),
wherein the carrier satisfies a relationship below;

$$500 \leq C \leq 1{,}000,$$

where C (nm) is a volume average particle diameter D50 of the magnesium compound particles or the barium compound particles.

(5) A two-component developer including:
the carrier according to any one of (1) to (4); and a toner.

(6) A replenishing developer including:
a carrier; and
a toner,
wherein the replenishing developer includes from 2 parts by mass through 50 parts by mass of the toner relative to 1 part by mass of the carrier and the carrier is the carrier according to any one of (1) to (4).

(7) An image forming apparatus including:
the two-component developer according to (5);
an electrostatic latent image bearer;
a charging unit configured to charge the electrostatic latent image bearer;
an exposing unit configured to form an electrostatic latent image on the electrostatic latent image bearer;
a developing unit configured to develop the electrostatic latent image formed on the electrostatic latent image bearer with the two-component developer to form a toner image;
a transferring unit configured to transfer the toner image formed on the electrostatic latent image bearer to a recording medium; and
a fixing unit configured to fix the toner image transferred to the recording medium.

(8) A toner stored unit including:
a unit; and
the two-component developer according to (5) or the replenishing developer according to (6) stored in the unit.

It is important that the carrier for a developer of an electrostatic latent image of the present disclosure includes magnesium compound particles or barium compound particles as metal compound particles.

Among metal elements that tend to be positively charged, magnesium and barium can be stably present inside a carrier resin layer.

As long as the exposed amount B is within the range represented by (1) above, the positively charged particles are continuously exposed from inside even when scraping of the film occurs due to hazard the resin layer receives inside a device. Therefore, a charging ability does not deteriorate over time, and a problem associated with image quality, such as toner scattering, does not occur.

Even when a surface of the carrier is polluted at some degrees due to filming of a toner component, charging sites can be maintained by using an appropriate size of particles. Therefore, there is an effect of maintaining charging ability of the carrier.

In the case of B>10.0, the amount of the positively charged particles is excessively large and therefore charge of the carrier increases. Accordingly, a charge amount of a device increases, and carrier deposition becomes significant on edge portions. In a temperature and humidity environment that can give high charge, such as a low-temperature and low-humidity environment, moreover, image density (ID) decreases due to lack of developability.

In the case of 1.2>B, the amount of the positively charged particles is excessively small and therefore charge of the carrier decreases. Accordingly, a charging amount of a device decreases and toner scattering occurs.

Moreover, the exposed amount B more preferably satisfies:

$$8.0 \geq B \geq 3.0$$

The magnesium compound particles or the barium compound particles of the metal compound particles are not particularly limited. Examples of the magnesium compound particles or the barium compound particles include MgO, Mg(OH), and $BaSO_4$.

As a method for controlling the exposed amount B of the metal compound particles, for example, the exposed amount B can be controlled by an amount of the metal compound particles or a drying time of the carrier.

The drying time of the carrier means, for example, a duration of a step for drying performed after completion of coating of a dispersion liquid including the metal compound particles on surfaces of core particles by SPIRA COTA (available from OKADA SEIKO CO., LTD.).

As an amount of the metal compound particles included in the resin layer, moreover, the metal compound particles are included in an amount of from 50 parts by mass through 300 parts by mass relative to 100 parts by mass of the resin. When the amount of the metal compound particles is 50 parts by mass or greater, the particles are sufficiently exposed on an outermost surface of a carrier to sufficiently exhibit an effect of imparting charging ability. When the amount of the metal compound particles is 300 parts by mass or less, a ratio of the resin exposed to a surface of a carrier does not become relatively small and therefore the particles are not fallen off from a coating film. Moreover, the toner is hardly spent on a surface of a carrier and as a result, a problem, such as an increase in resistance, hardly occurs.

The metal compound particles are preferably barium compound particles.

The details are not clear, but it has been clearly understood from the results of studies that a carrier produced using barium compound particles improves stability of charging compared to a carrier using magnesium compound particles. As a case where charge stability is improved, for example, there is a case that a difference in a charging amount between a high-temperature and high-humidity environment and a low-temperature and low-humidity environment is small compared to a case when the magnesium compound particles are used. When particles having low charge stability are used, other than the barium compound particles or magnesium compound particles, charging ability is not robust depending on the conditions for use in the market, and therefore various problems associated with image quality, such as toner scattering, carrier deposition on edge portions, carrier deposition on a solid image, and reduction in ID, occur.

When a volume average particle diameter D50 of the magnesium compound particles or barium compound particles is determined as C (nm), C preferably satisfies the following relationship:

$$500 \leq C \leq 1{,}000 \quad (2)$$

When the volume average particle diameter D50 is within the range of (2) under the conditions that a surface of a carrier is polluted at some degrees, the metal compound particles having charge ability on the surface of the carrier are not embedded in the filmed toner and charging sites can be maintained, and therefore an effect of maintain charging ability of the carrier is exhibited.

In the case of C<500, the particle diameters of the particles are excessively small, and therefore charging sites are covered with the filmed toner. As a result, charging ability of the carrier cannot be maintained and tends to be lowered.

In the case of 1,000<C, the particle diameters of the particles are excessively large, and therefore the particles cannot be held with the resin and may be fell off from the resin. Accordingly, charge maintainability may be decreased by the detachment of the particles and toner scattering tends to occur. Moreover, scraping of the resin is accelerated and therefore resistance reduces due to exposure of the core and carrier deposition tend to occur.

The exposed amount B of magnesium or barium on a surface of the carrier is determined with a value evaluated by AXIS/ULTRA (available from Shimadzu/KRATOS). The beam irradiation region is the size of about 900 μm×about 600 μm and a region of 25 carrier particles×17 carrier particles is detected. Moreover, the penetration depth is from 0 nm through 10 nm and information near a surface of the carrier is detected.

As a specific measuring method, a measurement is performed under the conditions that a measuring mode is Al, 1486.6 eV, an excitation source is a monochrome (Al), a detection system is a spectrum mode, and a magnet lens is off. First, detected elements are identified by wide scan. Then, a peak is detected per detected element by narrow scan. Thereafter, atomic % is calculated by the attached peak analysis software.

In the present disclosure, a resin covering a surface of the core particle is desirably a resin that includes an A segment (and Monomer A Component for the A segment, the A segment is defined as the same hereinafter) represented by Structural Formula 1 below and a B segment (and Monomer B Component for the B segment, the B segment is defined as the same hereinafter) represented by Structural Formula 2 below, and is obtained by covering the surface of the core particle with an acryl-based copolymer obtained by radical copolymerization, followed by a heating treatment.

A segment (Monomer A Component therefore):

Structural Formula 1

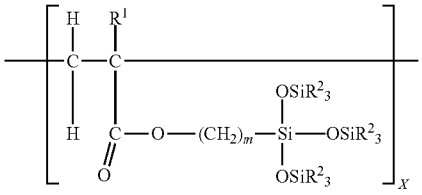

In the structural formula above, $R^1$: a hydrogen atom or a methyl group m: an integer of from 1 through 8 where $(CH_2)_m$ is an alkylene group, such as a methylene group, an ethylene group, a propylene group, and a butylene group $R^2$: an alkyl group having from 1 through 4 carbon atoms, such as a methyl group, an ethyl group, a propyl group, and a butyl group X: from 10 mol % through 90 mol %

Note that, X and Y represent a composition ratio of the A segment represented by Structural Formula 1 and the B segment represented by Structural Formula 2 in a copolymer.

In the A segment (and Monomer A Component), X is from 10 mol % through 90 mol %, preferably from 10 mol % through 40 mol %, and more preferably from 20 mol % through 30 mol %.

The A segment (Monomer A Component) includes tris(trialkylsiloxy)silane, which is an atomic group including the large number of alkyl groups in a side chain thereof. As a ratio of the A segment (Monomer A Component) increases relative to the entire resin, surface energy reduces, leading to less deposition of a resin component or a wax component of the toner. When the A segment (Monomer A Component) is 10 mol % or greater, a sufficient effect can be obtained, and deposition of the toner component reduces. When the B segment (Monomer B Component) is 90 mol % or less, moreover, toughness will not be insufficient, adhesion between the core and the resin layer improves, and durability of a carrier coating film improved.

$R^2$ is an alkyl group having from 1 through 4 carbon atoms, and examples of Monomer A component for constituting such an A segment include tris(trialkylsiloxy)silane compounds represented by the following formulae.

In the formulae below, Me is a methyl group, Et is an ethyl group, and Pr is a propyl group.

$CH_2{=}CMe\text{-}COO{-}C_3H_6{-}Si(OSiMe_3)_3$ $CH_2{=}CH{-}COO{-}C_3H_6{-}Si(OSi(Me_3)_3$ $CH_2{=}CMe\text{-}COO{-}C_4H_8{-}Si(OSiMe_3)_3$ $CH_2{=}CMe\text{-}COO{-}C_3H_6{-}Si(OSiEt_3)_3$ $CH_2{=}CH{-}COO{-}CH_6{-}Si(OSiEt_3)_3$ $CH_2{=}CMe\text{-}COO{-}C_4H_8{-}Si(OSiEt_3)_3$ $CH_2{=}CMe\text{-}COO{-}C_3H_6{-}Si(OSiPr_3)_3$ $CH_2{=}CH{-}COO{-}C_3H_6{-}Si(OSiPr_3)_3$ $CH_2{=}CMe\text{-}COO{-}C_4H_8{-}Si(OSiPr_3)_3$ A production method of Monomer Component A for the A segment is not particularly limited. The A segment can be obtained by a method where tris(trialkylsiloxy)silane is allowed to react with allyl acrylate or allyl methacrylate in the presence of a platinum catalyst, or a method disclosed in Japanese Unexamined Patent Application Publication No. 11-217389 where methacryloxyalkyl trialkoxysilane and hexaalkyl disiloxane are allowed to react in the presence of carboxylic acid and an acid catalyst.

B segment (and Monomer B Component/Precursor Monomer B): (crosslinking component)

Structural Formula 2

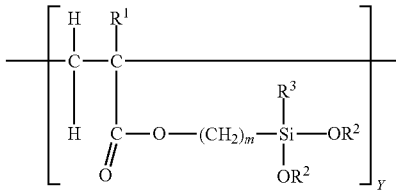

In the structural formula above, $R^1$: a hydrogen atom or a methyl group m: an integer of from 1 through 8, and $(CH_2)_m$ is an alkylene group, such as a methylene group, an ethylene group, a propylene group, and a butylene group $R^2$: an alkyl group having from 1 through 4 carbon atoms, such as a methyl group, an ethyl group, a propyl group, and a butyl group $R^3$: an alkyl group having from 1 through 8 carbon atoms (e.g., a methyl group, an ethyl group, a propyl group, and a butyl group) or an alkoxy group having 1 through 4 carbon atoms (e.g., a methoxy group, an ethoxy group, a propoxy group, and a butoxy group)

Namely, Monomer B Component (including a precursor) for the B segment is a radically polymerizable bifunctional (the case where $R^3$ is an alkyl group) or trifunctional (the case where $R^3$ is also an alkoxy group) silane compound, and Y is from 10 mol % through 90 mol %, preferably from 10 mol % through 80 mol %, and more preferably from 15 mol % through 70 mol %.

When the B component is 10 mol % or greater, sufficient toughness can be obtained. When the B component is 90 mol % or less, a problem that a coating film is hard and brittle can be prevented and scraping of a film hardly occurs. Moreover, a deterioration in environmental properties can be prevented. This is because the environmental properties (humidity dependency) are assumed to be deteriorated when a large number of the hydrolyzed crosslinked component remain as silanol groups.

Examples of Monomer B Component include 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltri(isopropoxy)silane, and 3-acryloxypropyltri(isopropoxy)silane.

A technology for increasing durability of a coating film through crosslinking is disposed in Japanese Patent No. 3691115.

In Japanese Patent No. 3691115 discloses a carrier for a developer of a latent electrostatic image, where the carrier include magnetic particles, each surface of which is coated with a thermosetting resin prepared by crosslinking a copolymer of an organo polysiloxane including a vinyl group at least at a terminal thereof and a radical copolymerizable monomer including at least one functional group selected from the group consisting of a hydroxyl group, an amino group, an amide group, and an imide group, with an isocyanate-based compound. However, it is a current situation that the disclosed carrier cannot have sufficient durability in terms of peeling and scraping of the coating film.

Although a reason for the above-mentioned insufficient durability is not clear, in case of the thermosetting resin prepared by crosslinking the copolymer with the isocyanate compound, the number of functional groups (active hydrogen-containing groups, such as an amino group, a hydroxyl group, a carboxyl group, and a mercapto group) per unit mass is small, which can be seen from the structural formula. It is therefore assumed that a dense two-dimensional or three-dimensional crosslinked structure cannot be formed at crosslinking points and hence peeling or scraping of the coating film (abrasion resistance of the coating film is low) tends to occur when the carrier is used for a long period, and sufficient durability cannot be obtained.

When peeling or scraping of the coating film occurs, a change in image quality and carrier deposition occur due to a reduction in resistance of the carrier. Moreover, the peeling or scraping of the coating layer decreases flowability of a developer to reduce an amount of the developer taken up, causing low image density, background fog due to an increase toner density (TC), and toner scattering.

In the present disclosure, use of a resin layer prepared by crosslinking a copolymer resin having the large number (twice or three times larger per unit mass) of bifunctional or trifunctional crosslinkable functional groups (points) per unit mass of the resin through condensation polymerization can form a coating film that is extremely tough and hard to be scraped and can achieve high durability.

Moreover, the crosslinkage with siloxane bonds used in the resin of the present disclosure has larger bonding energy and is more stable to heat stress than crosslinkage with the isocyanate compound. Therefore, it is assumed that the coating film for use in the present disclosure can ensure stability over time.

In the present disclosure, the copolymer may include a C segment represented by Structural Formula 4 in order to impart sufficient flexibility and obtain desirable adhesion between the core and the resin layer and between the resin layer and the metal compound particles.

C Segment (and Monomer C Component): (Acryl Component)

Structural Formula 4

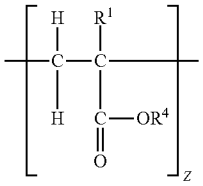

In the structural formula above, $R^1$: a hydrogen atom or a methyl group $R^4$: an alkyl group having from 1 through 4 carbon atoms or an alkyl group that has from 1 through 4 carbon atoms and may be substituted with an amino group The C component is a radically polymerizable acryl-based compound having an acryloyl group or a methacryloyl group.

When ratios of the A component, the B component, and the C component are determined as x, y, z, respectively, in the case where the C component is included, amounts of the A component and the B component are that x is from 10 mol % through 40 mol % and y is from 10 mol % through 40 mol %, and an amount of the C component is that z is from 30 mol % through 80 mol % and preferably from 35 mol % through 75 mol %, as well as being 60 mol %<y+z<90 mol %, more preferably 70 mol %<y+z<85 mol %.

When the C component (Monomer C Component) is 80 mol % or less, one of x and y does not become 10 mol % or less, and all of water repellency, hardness, and flexibility (film scraping) of the carrier coating can be obtained.

As an acryl-based compound (monomer) of Monomer C Component for the C segment, acrylic acid esters and methacrylic acid esters are preferable. Specific examples thereof include methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino)propyl acrylate, 2-(diethylamino) ethyl methacrylate, and 2-(diethylamino)ethyl acrylate. Among the above-listed examples, alkyl methacrylate is preferable and methyl methacrylate is particularly preferable. Moreover, the above-listed compounds may be used alone or as a mixture of two or more.

The above-mentioned copolymer resin is an acryl-based copolymer obtained through radical copolymerization of a monomer including A Component and a monomer including B Component. The copolymer resin is obtained by condensation polymerization of the crosslinking component B segment by a heat treatment to crosslink as well as having a number of crosslinkable functional groups per unit mass of the resin. Therefore, it is assumed that the resin layer is extremely tough and hardly scraped, and high durability thereof is achieved.

Moreover, the crosslinkage with siloxane bonds used in the resin of the present disclosure has larger bonding energy and is more stable to heat stress than crosslinkage with the isocyanate compound. Therefore, it is assumed that the resin layer for use in the present disclosure can ensure stability over time.

In the present disclosure, a composition used for forming a resin layer preferably include a silicone resin including a silanol group and/or a functional group capable of generating a silanol group through hydrolysis. The silicone resin including a silanol group and/or a functional group capable of generating a silanol group through hydrolysis (e.g., an alkoxy group, and a negative group, such as a halogeno group bonded to a Si atom) can be directly condensation-polymerized with the crosslinking component B site of the copolymer, or with the crosslinking component B site in the state where it is changed to a silanol group. Toner spent resistance is further improved by including the silicone resin component in the copolymer.

In the present disclosure, the silicone resin including a silanol group and/or a functional group capable of generating a silanol group through hydrolysis for use in formation of a resin layer preferably includes at least one repeating unit represented by General Formula (I) below.

(I)

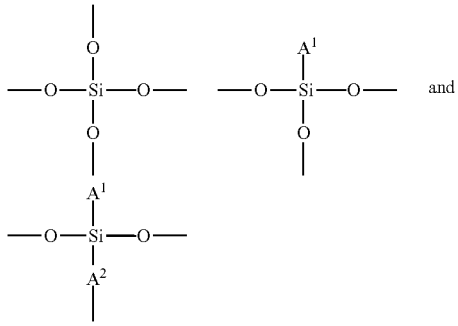

In the formula (I) above, $A^1$ is a hydrogen atom, a halogen atom, a hydroxyl group, a methoxy group, a lower alkyl group having from 1 through 4 carbon atoms, or an aryl group (e.g., a phenyl group and a tolyl group), and $A^2$ is an alkylene group having from 1 through 4 carbon atoms or an arylene group (e.g., a phenylene group).

In the aryl group of the formula above, the number of carbon atoms is from 6 through 20, and preferably from 6 through 14. The aryl group includes, other than an aryl group derived from benzene (a phenyl group), an aryl group derived from condensed polycyclic aromatic hydrocarbon, such as naphthalene, phenanthrene, and anthracene, and an aryl group derived from chain polycyclic aromatic hydrocarbon, such as biphenyl and terphenyl. Note that, the aryl group may be substituted with various substituents.

Commercial products of the silicone resin for use in the present disclosure are not particularly limited. Examples of the commercial product include: KR251, KR271, KR272, KR282, KR252, KR255, KR152, KR155, KR211, KR216, and KR213 (all available from Shin-Etsu Silicone); and AY42-170, SR2510, SR2400, SR2406, SR2410, SR2405, and SR2411 (available from Dow Corning Toray Co., Ltd.) (available from Toray Silicone).

As described above, various silicone resins can be used. Among the above-listed silicone resins, a methyl silicone resin is particularly preferable because of low toner spent and a small fluctuation in a charge amount due to environmental conditions.

A weight average molecular weight of the silicone resin is from 1,000 through 100,000 and preferably from about 1,000 through about 30,000. When the weight average molecular weight of the resin for use is greater than 100,000, a viscosity of a coating liquid is increased too high at the time of coating no to be able to sufficiently obtain uniformity of a coating film, or density of the resin layer after curing may not be sufficient. When the weight average molecular weight is smaller than 1,000, a problem tends to occur, such as a problem that a resultant resin layer after curing tends to become brittle.

The silicone resin content in the copolymer is from 5% by mass through 95% by mass and preferably from 10% by mass through 60% by mass. When the silicone resin content is less than 5% by mass, an effect of improving spent cannot be obtained. When the silicone resin content is greater than 95% by mass, toughness of the resin layer is insufficient and the film is easily scraped.

Moreover, the resin layer composition of the present disclosure may include a resin other than the silicone resin including a silanol group and/or a hydrolyzable functional group. Such a resin is not particularly limited. Examples of the resin include an acrylic resin, an amino resin, a polyvinyl-based resin, a polystyrene-based resin, a halogenated olefin resin, polyester, polycarbonate, polyethylene, polyvinyl fluoride, polyvinylidene fluoride, polytrifluoroethylene, polyhexafluoropropylene, a copolymer of vinylidene fluoride and vinyl fluoride, a fluoroterpolmer (e.g., a terpolymer of tetrafluoroethylene, vinylidene fluoride, and a non-fluoromonomer), and a silicone resin free from a silanol group or a hydrolyzable functional group. The above-listed examples may be used in combination. Among the above-listed examples, an acrylic resin is preferable because of strong adhesion to core particles and conductive particles and low brittleness.

The acrylic resin preferably has a glass transition temperature of from 20° C. through 100° C., and more preferably from 25° C. through 80° C. Such an acrylic resin has appropriate elasticity. When a developer is charged through friction, therefore, the acrylic resin can absorb impacts at the time strong impacts are applied to the resin layer through friction between a toner and the carrier or between carrier particles, and deterioration of the resin layer and the conductive particles can be prevented.

Moreover, the resin layer composition more preferably includes a crosslinked product of an acrylic resin and an amino resin. When the resin layer composition includes the crosslinked product, fusion between the resin layers can be prevented while maintaining appropriate elasticity. The amino resin is not particularly limited. The amino resin is preferably a melamine resin or a benzoguanamine resin because the above-mentioned resins can improve a charge imparting ability of a carrier. In the case where it is desired to appropriately control the charge imparting ability of the carrier, moreover, another amino resin may be used in combination with the melamine resin and/or the benzoguanamine resin.

The acrylic resin that can be crosslinked with the amino resin is preferably an acrylic resin including a hydroxyl group and/or a carboxyl group, and more preferably an acrylic resin including a hydroxyl group. Use of such an acrylic resin can improve adhesion to the core particles and conductive particles, and can improve dispersion stability of the conductive particles. A hydroxyl value of the acrylic resin is preferably 10 mgKOH/g or greater and more preferably 20 mgKOH/g or greater.

Moreover, a titanium-based catalyst, a tin-based catalyst, a zirconium-based catalyst, and an aluminium-based catalyst can be used in order to accelerate a condensation reaction of the crosslinking component B segment. Among the above-listed various catalysts and titanium-based catalysts that can provide excellent results, titanium alkoxide and a titanium chelate are preferable.

Use of such a catalyst is preferable because an effect of accelerating a condensation reaction of a silanol group derived from the crosslinking component B segment is large and a catalyst is not easily deactivated. Examples of the titanium alkoxide-based catalyst include titanium diisopropoxybis(ethylacetoacetate) represented by Structural Formula 5 below. Moreover, examples of the titanium chelate-based catalyst include titanium diisopropoxybis(triethanolaminate) represented by Structural Formula 6 below.

$Ti(O\text{-}i\text{-}C_3H_7)_2(C_6H_9O_3)_2$ Structural Formula 5

$Ti(O\text{-}i\text{-}C_3H_7)_2(C_6H_{14}O_3N)_2$ Structural Formula 6

The resin layer can be formed using a resin layer composition including a copolymer including the A component and the B component, a titanium diisopropoxybis(ethylacetoacetate) catalyst, and optionally a resin other than the copolymer including the A component and the B component, and a solvent.

Specifically, the resin layer may be formed by condensing silanol groups while coating core particles with the resin layer composition, or condensing silanol groups after coating the core particles with the resin layer composition.

A method for condensing silanol groups while coating the core particles with the resin layer composition is not particularly limited. Examples of the method include a method where core particles are coated with a resin layer composition while applying heat, light, etc. Moreover, a method for condensing silanol group after coating the core particles with the resin layer composition is not particularly limited. Examples of the method include a method where heating is performed after coating core particles with a resin layer composition.

Moreover, a resin having a large molecular weight typically has an extremely high viscosity. When the resin is applied to base particles having small particle diameters, aggregation of the particles and unevenness of a resin layer tend to be caused, and it is extremely difficult to produce a coated carrier.

Accordingly, the copolymer resin preferably has a weight average molecular weight of from 5,000 through 100,000, more preferably from 10,000 through 70,000, and even more preferably from 30,000 through 40,000. When the weight average molecular weight of the copolymer resin is less than 5,000, the strength of the resin layer is insufficient. When the weight average molecular weight of the copolymer resin is greater than 100,000, liquid viscosity becomes high and manufacturability of a carrier becomes poor.

In the present disclosure, the resin layer composition preferably includes an aminosilane coupling agent.

The aminosilane coupling agent is not particularly limited. Examples of the aminosilane coupling agent include r-(2-aminoethyl)aminopropyltrimethoxysilane, r-(2-aminoethyl)aminopropylmethyldimethoxysilane, N-ß-(N-vinylbenzylaminoethyl)-r-aminopropyltrimethoxysilane hydrochloric acid salt, 3-aminopropylmethyldiethoxysilane, and 3-aminopropyltrimethoxysilane. The above-listed examples may be used in combination.

An amount of the silane coupling agent is preferably from 0.1% by mass through 10% by mass relative to the silicone resin. When the amount of the silane coupling agent is 0.1% by mass or greater, adhesion between the silicone resin with core particles or conductive particles improves, and therefore a problem that the resin layer is fell off during use of a long period can be prevented. When the amount of the silane coupling agent is 10% by mass or less, occurrences of filming of a toner during use of a long period can be prevented.

In the present disclosure, moreover, a volume average particle diameter of the carrier is preferably 20 μm or greater but 45 μm or less. When the volume average particle diameter of the carrier is 20 μm or greater, magneticity per particle becomes strong and therefore it is difficult to cause carrier deposition. When the volume average particle diameter of the carrier is 45 μm or less, an impact force when carrier particles are crushed each other does not become too large and stress against convex portions of the carrier surface layer becomes small, and therefore embodiment of particles or scraping of particles can be prevented and the convex portion of the carrier surface layer can secure sufficient charging ability and a charge amount of a developer can be maintained constant when toner spent occurs.

The volume average particle diameter of the carrier can be measured by means of SRA type Microtrac particle size analyzer (available from NIKKISO CO., LTD.). The measurement is performed with a range setting of 0.7 μm or greater but 125 μm or less. Moreover, methanol is used to prepare a dispersion liquid, a refractive index is set to 1.33, and a refractive index of the carrier and core is set to 2.42.

In the present disclosure, the resin coating layer is a layer having no defected portion and an average film thickness of the resin coating layer is preferably from 0.30 μm through 0.90 μm.

It has been found from the researches conducted in the past that scraping of a film is significant when a resin layer is too thin, and toner spent tends to occur when the resin layer is too thick. The film scraping of the carrier and the toner spent both occur at some degrees with a relationship of trade-off. Therefore, a thickness of the resin layer is determined based on whether the film scraping or the toner spent is desired to appear less.

When the average film thickness is 0.30 μm or greater, the resin coating layer is unlikely destroyed during usage and the film is not scraped. When the average film thickness is 0.90 μm or less, moreover, toner spent due to high resistance of a toner resin hardly occurs, resistance of the carrier does not increase, and carrier deposition tends not to occur on edge portions.

In the present disclosure, particles other than particles of a barium compound or a magnesium compound are preferably included as a resistance adjusting material for the carrier. Examples of the conductive particles include carbon black, conductive titanium oxide or tin oxide, oxygen-deficient phosphorus-doped tin (ITO), and oxygen-deficient tungsten-doped tin (WTO).

Carbon black is preferable because conductivity can be exhibited with a small amount of the carbon black added. When the conductive carbon black is detached from the resin coating layer, however, the carbon black stains and pollutes a toner when the toner is a color toner. When the color toner is used, antimony-doped conductive titanium oxide, oxygen-deficient phosphorus-doped tin (ITO), or oxygen-deficient tungsten-doped tin (WTO) may be used as conductive particles.

In the present disclosure, the core particles are not particularly limited as long as the core particles are formed of a magnetic material. Examples thereof include: ferromagnetic metals such as iron and cobalt; iron oxide, such as magnetite, hematite, and ferrite; various alloys and compounds; resin particles containing any of the above-listed magnetic materials dispersed in a resin. Among the above-listed examples, Mn-based ferrite, Mn—Mg-based ferrite, and Mn—Mg—Sr ferrite are preferable in view of environmental friendliness.

A two-component developer of the present disclosure includes the carrier of the present disclosure and a toner.

The toner includes a binder resin and a colorant, and the toner may be a monochromic toner or a color toner. Moreover, toner particles may include a release agent in order to be applicable for an oilless system where no oil for preventing toner adhesion is applied to a fixing roller. The toner including the release agent generally tends to cause filming. Since the carrier of the present disclosure can maintain charging sites even when filming occurs, the developer of the present disclosure can maintain excellent quality over a long period over a long period.

The toner can be produced by a method known in the art, such as a pulverization method and a polymerization method. The carrier for a developer of an electrostatic latent image of the present disclosure can obtain the same effect whether a toner produced by a pulverization method known in the art is used or a toner produced by a polymerization method known in the art is used.

In a case where the toner is produced by the pulverization method, for example, first, toner materials are kneaded to obtain a melt-kneaded product, the melt-knead product is cooled, and then the cooled melt-kneaded product is pulverized, followed by performing classification, to thereby produce base particles. In order to further improve transferring performance and durability, subsequently, external additives are added to the base particles to thereby produce a toner.

A device for kneading the toner material is not particularly limited. Examples of the device include: batch-type twin rolls; Banbury mixers; continuous twin screw extruders, such as KTK twin-screw extruder (available from Kobe Steel, Ltd.), TEM twin-screw kneader (available from TOSHIBA MACHINE CO., LTD.), a twin-screw extruder (available from KCK), PCM twin-screw extruder (available from IKEGAI), and KEX twin-screw extruder (available from Kurimoto, Ltd.); and continuous single screw kneaders, such as a co-kneader (available from BUSS).

When the cooled melt-kneaded product is pulverized, the melt-kneaded product is roughly pulverized by means of a hummer mill, Rotoplex, etc., followed by finely pulverizing the resultant using a fine pulverizer using a jet flow or a mechanical fine pulverizer. Note that, the pulverization is preferably performed in a manner that an average particle diameter of the resultant particles is to be from 3 μm through 15 μm.

When the pulverized melt-kneaded product is classified, moreover, a wind classifier etc. can be used. Note that, the classification is preferably performed in a manner that an average particle diameter of the base particles is to be from 5 μm through 20 μm.

When external additives are added to the base particles, moreover, the external additives are crushed and deposited on surfaces of the base particles by mixing and stirring using a mixer etc.

The binder resin is not particularly limited. Examples of the binder resin include: homopolymers of styrenes and substituted products of styrenes, such as polystyrene, poly (p-styrene), and polyvinyl toluene; styrene-based copolymers, such as styrene-p-chlorostyrene copolymers, styrene-propylene copolymers, styrene-vinyl toluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-methyl vinyl ketone copolymers, styrene-butadiene copolymers, styrene-isoprene copolymers, and styrene-maleic acid ester copolymers; polymethyl methacrylate; polybutyl methacrylate; polyvinyl chloride; polyvinyl acetate; polyethylene; polyester; polyurethane; epoxy resins; polyvinyl butyral; polyacrylic acid; rosin; modified rosin; terpene resin; phenol resin; aliphatic or aromatic hydrocarbon resins; and aromatic-based petroleum resins. The above-listed examples may be used in combination.

The bind resin for pressure fixing is not particularly limited. Examples of the binder resin for pressure fixing include: polyolefin such as low-molecular-weight polyethylene and low-molecular-weight polypropylene; olefin copolymers, such as ethylene-acrylic acid copolymers, ethylene-acrylic acid ester copolymers, styrene-methacrylic acid copolymers, ethylene-methacrylic acid ester copolymers, ethylene-vinyl chloride copolymers, ethylene-vinyl acetate copolymers, and ionomer resins; epoxy resins; polyester; styrene-butadiene copolymers; polyvinyl pyrrolidone; methyl vinyl ether-maleic anhydride copolymers; maleic acid-modified phenol resins; and phenol-modified terpene resins. The above-listed examples may be used in combination.

The colorant (pigment or dye) is not particularly limited. Examples of the colorant include: yellow pigments, such as cadmium yellow, mineral fast yellow, nickel titanium yellow, Naples yellow, Naphthol Yellow S, Hansa Yellow G, Hansa Yellow 10G, Benzidine Yellow GR, quinoline yellow lake, Permanent Yellow NCG, and tartrazine lake; orange pigments, such as molybdate orange, Permanent Orange GTR, pyrazolone orange, Vulcan orange, Indanthrene Brilliant Orange RK, benzidine orange G, and Indanthrene Brilliant Orange GK; red pigments, such as red iron oxide, cadmium red, Permanent Red 4R, lithol red, pyrazolone red, watching red calcium salt, Lake Red D, Brilliant Carmine 6B, eosin lake, Rhodamine Lake B, alizarin lake, and Brilliant Carmine 3B; violet pigments, such as Fast Violet B and methyl violet lake; blue pigments, such as cobalt blue, alkali blue, Victoria blue lake, phthalocyanine blue, metal-free phthalocyanine blue, partially chlorinated phthalocyanine blue, fast sky blue, and Indanthrene Blue BC; green pigments, such as chrome green, chromium oxide, Pigment Green B, and malachite green lake; and black pigments, such as carbon black, oil furnace black, channel black, lamp black, acetylene black, azine dyes (e.g., aniline black), metal salts of azo dyes, metal oxides, and composite metal oxides. The above-listed examples may be used in combination.

The release agent is not particularly limited. Examples of the release agent include polyolefin (e.g., polyethylene and polypropylene), fatty acid metal salts, fatty acid esters, paraffin wax, amide-based wax, polyvalent alcohol wax, silicone varnish, carnauba wax, and ester wax. The above-listed examples may be used in combination.

Moreover, the toner may further include a charge-controlling agent. The charge-controlling agent is not particularly limited. Examples of the charge-controlling agent include: nigrosine; azine-based dyes including alkyl groups having from 2 through 16 carbon atoms (see Japanese Examined Patent Publication No. 42-1627); basic dyes, such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue (C.I. 52025), C.I. Basic Blue 26 (C.I. 44045), C.I. Basic Green 1 (C.I. 42040), and C.I. Basic Green 4 (C.I. 42000); lake pigments of the above-listed basic dyes; quaternary ammonium salts, such as C.I. Solvent Black 8 (C.I. 26150), benzoylmethylhexadecyl ammonium chloride, and decyltrimethyl chloride; alkyl tin compounds such as dibutyl tin compounds and dioctyl tin compounds; dialkyl tin borate compounds; guanidine derivatives; polyamine resins, such as vinyl-based polymers including amino groups and condensate-based polymers including amino groups; metal complex salts of monoazo dyes disclosed in Japanese Examined Patent Publication Nos. 41-20153, 43-27596, 44-6397, and 45-26478; salicylic acids disclosed in Japanese Examined Patent Publication Nos. 55-42752 and 59-7385; metal (e.g., Zn, Al, Co, Cr, and Fe) complexes of dialkyl salicylate, naphthoic acid, and dicarboxylic acid; sulfonated copper phthalocyanine pigments; organic boron salts; fluorine-containing quaternary ammonium salts; and calixarene-based compounds. The above-listed examples may be used in combination. Note that, white metal salts of salicylic acid derivatives etc. are preferable for a color toner other than a black toner.

The external additives are not particularly limited. Examples of the external additives include: inorganic particles, such as silica, titanium oxide, alumina, silicon carbide, silicon nitride, and boron nitride; and resin particles having an average particle diameter of from 0.05 μm through 1 μm obtained by a soap-free emulsion polymerization method, such as polymethyl methacrylate particles and polystyrene particles. The above-listed examples may be used in combination. Among the above-listed examples, metal oxide particles, such as silica and titanium oxide surfaces of which are subjected to a hydrophobic treatment, are preferable. Moreover, a toner having excellent charging stability against humidity can be obtained by using hydrophobic-treated silica and hydrophobic-treated titanium oxide in combination and adjusting an amount of the hydrophobic-treated titanium oxide larger than an amount of the hydrophobic-treated silica.

Stable image quality can be obtained over an extremely long period by using the carrier of the present disclosure for a replenishing developer composed of the carrier and a toner in an image forming apparatus that is configured to perform image formation while ejecting an excess amount of the developer inside the developing device. Namely, the deteriorated carrier inside the developing device is replaced with a carrier that is not deteriorated and is in the replenishing developer to stably maintain a charge amount over a long period and to provide a stable image. Such a system is particularly effective for printing of a large imaging area. At the time of printing of a large imaging area, a main deterioration of the carrier is a deterioration associated with charging of the carrier due to toner spent on the carrier. When the above-mentioned system is used, a supplied amount of the carrier increases at the time of printing of a large image area and therefore the deteriorated carrier is replaced often. Therefore, a stable image can be obtained over an extremely long period.

A blending ratio of the replenishing developer is preferably that from 2 parts by mass through 50 parts by mass of the toner is blended with 1 part by mass of the carrier. When the amount of the toner is 2 parts by mass or greater, an amount of the supplied carrier is not excessively large and it is possible to prevent an increase in a charge amount of the developer. When the charge amount of the developer increases, a developing performance decreases to lower image density. When the amount of the toner is 50 parts by mass or less, moreover, a ratio of the carrier in the replenishing developer is not small and therefore the carrier in an image forming apparatus is replaced, and an effect for preventing carrier deterioration can be expected.

The image forming apparatus of the present disclosure includes an electrostatic latent image bearer, a charging unit configured to charge the electrostatic latent image bearer, an exposing unit configured to form an electrostatic latent image on the electrostatic latent image bearer, a developing unit configured to develop the electrostatic latent image formed on the electrostatic latent image bearer with a developer to form a toner image, a transferring unit configured to transfer the toner image formed on the electrostatic latent image bearer to a recording medium, and a fixing unit configured to fix the toner image transferred to the recording medium. The image forming apparatus may further include appropriately selected other units, such as a charge-eliminating unit, a cleaning unit, a recycling unit, and a controlling unit, according to the necessity. The image forming apparatus uses, as a developer, the two-component developer of the present disclosure.

In the present embodiment, the two-component developer including the above-described carrier and a toner is used as a replenishing developer or a developer for use inside a developing device in a torque developing system. Therefore, sufficient charge controlling ability and durability corresponding to image quality and durability desired in the market are secured, a developer can be stably supplied to a developing region, and continuous printing at a printing density of a low imaging area rate can be performed by a high-speed device using a low-temperature fixing toner.

Note that, a structure of the image forming apparatus for use in the present disclosure is not particularly limited. An image forming apparatus having other structure can be used as long as the image forming apparatus has the same functions.

The developer for use inside the developing device desirably has a toner concentration of from 3% by mass through 11% by mass in the developer.

The image forming method of the present disclosure includes a step including forming an electrostatic latent image on an electrostatic latent image bearer, a step including developing the electrostatic latent image formed on the electrostatic latent image bearer with the two-component developer of the present disclosure to form a toner image, a step including transferring the toner image formed on the electrostatic latent image bearer to a recording medium, and a step including fixing the toner image transferred to the recording medium.

The toner stored unit of the present disclosure includes a unit having a function of storing a toner, and the developer of the present disclosure stored in the unit. Examples of an embodiment of the toner stored unit include a developer stored container, a developing device, and a process cartridge.

The developer stored container is a container that stores therein a developer.

The developing device is a unit that stores therein a developer and is configured to perform developing.

The process cartridge includes an integrated body of at least an electrostatic latent image bearer and a developing unit, stores therein a developer, and is detachably mounted in an image forming apparatus. The process cartridge may further include at least one selected from the group consisting of a charging unit, an exposing unit, and a cleaning unit.

FIG. 1 is a schematic view illustrating a structure of the image forming apparatus of the present disclosure. FIG. 1 illustrates a tandem image forming apparatus including four image formation station. In each station, image formation of a different color is performed, and eventually a color image is obtained. Image formation will be described hereinafter.

The image forming apparatus 1 includes an automatic document feeder (ADF) 5 configured to feed a document, a scanner unit for reading a document 4, and an image forming unit 3 configured to electrically process a digital signal output from the scanner unit by an image processing unit to form an image on recording paper based on a digital signal output from the image processing unit. In the scanner unit 4, an image of a document placed on a document table is read by a color CCD through an irradiation lamp, a mirror, and a lens, and the data is sent to the image processing unit. In the image processing unit, any necessary processing is performed on the data to convert into an image signal and the image signal is sent to the image forming unit 3.

In the image forming unit 3, four image formation stations 10Y, 10C, 10M, and 10K using yellow (Y), cyan (C), magenta (M), black (K) toners are disposed parallel, and one intermediate transfer belt 21 and one secondary transfer roller 25 are arranged relative to the four image formation stations 10. As one example of the image forming station 10 constituting the image forming apparatus 1, a structure of the yellow image formation station 10Y is illustrated. Other image formation stations, i.e., the cyan image formation station 10C, the magenta image formation station 10M, and the black image formation station 10K have the same structures and operations unless otherwise stated.

Note that, the image formation station 10 can be used as a process cartridge 10 that is detachably mounted in a main body of the image forming apparatus 1.

Once the image formation operation is started, in the yellow image formation station 10Y, a surface of the photoconductor 11 that is an electrostatic latent image bearer is uniformly charged by the charging device 12 that is a charging unit. After uniformly negatively charging each of photoconductors 11Y, 11C, 11M, and 11K, in which an organic photoconductor layer is formed on a core electrically earthed, by each of charging devices 12Y, 12C, 12M, and 12K using corona discharge, light irradiation corresponding to each color is performed on an image area by each of exposing devices 30Y, 30C, 30M, 30K each including a light emitting unit composed of a laser diode, to form an electrostatic latent image on each of the photoconductors 11Y, 11C, 11M, and 11K.

Then, an electrostatic latent image corresponding to a yellow component image of a full color document is formed on the charged photoconductor 11 by exposure performed by the exposing device 30 for photowriting, and the electrostatic latent image is visualized with a yellow toner by the yellow developing device 13Y that is a developing unit. Moreover, the same image forming operation is performed in the cyan image formation station, the magenta image formation station, and the black image formation station 10 with the predetermined time lag, to form a toner image of each color of cyan, magenta, and black on each photoconductor 11. In order to superimpose the toner images Y, C, M, and Bk formed on the photoconductor 11 in the image formation stations 10Y, 10C, 10M, and 10K on an intermediate transfer belt 21 as one full is color image, a primary transfer roller 23 is disposed at the back side of the intermediate transfer belt 21 at the position facies the photoconductor 11 of each image formation station 10. The toner images of the image formation stations 10 are sequentially transferred and superimposed on the intermediate transfer belt 21 by applying the predetermined transfer bias to the primary transfer roller 23.

After transferring to the intermediate transfer belt 21, the surface potential of the photoconductor 11 in each image formation station 10 is eliminated by an optical charge eliminating unit, and the toner remained on the photoconductor 11 is removed by a cleaning blade of a cleaning device 19 that is a cleaning unit, and then the photoconductor is charged by the above-mentioned charging device 12. This image formation cycle is repeated. After transferring to the intermediate transfer belt 21, the charge of the surface of the photoconductor 11 is eliminated by the optical charge eliminating unit. Thereafter, the residue, such as the toner, is removed by the cleaning device 19. The toner removed by the cleaning device 19 is transported to the waste toner stored chamber via a waste toner transport channel.

After transferring the full color toner image to recording paper, deposited matter, such as the toner and paper dusts, remained on the surface of the intermediate transfer belt 21 are removed by a cleaning brush roller, or cleaning blade of an intermediate transfer belt-cleaning device 22, and the collected toner is transported to the waste toner stored unit in the same manner as the above-described waste toner from the photoconductor. The intermediate transfer belt 21 can switch between a state where the intermediate transfer belt 21 is in contact with the photoconductor 11 of each image formation station 10 and a state where the intermediate transfer belt 21 is separated from the photoconductor 11 by applying or releasing tension to or from the transfer belt using tension rollers 211 (a counter roller to the transfer roller 25), 212, and 213 disposed inside the transferring unit including therein the intermediate transfer belt 21, a transfer bias power source, and a belt driving axis, through the cam mechanism.

Owing to the above-mentioned mechanism, the intermediate transfer belt is turned in the state to be in contact with the photoconductor before rotation of the photoconductor 11 of each image formation station 10 starts at the time of the operation of the device, and is turned into a state to be separated from the photoconductor 11 at the time of the termination of the operation of the device. After transferring the toner image to the intermediate transfer belt 21, the charge of the surface of the photoconductor is eliminated by the optical charge eliminating unit. Then, first, a brush roller of the cleaning device 19 is brought into contact with the photoconductor and rotated in the counter direction to the rotational direction of the photoconductor (at an upstream position of the rotational direction of the photoconductor inside the cleaning unit) to scrape and loosen the residual toner and deposition on the photoconductor to reduce adhesion force to the photoconductor, and then a blade formed of a rubber elastic body is brought into contact with the photoconductor 11 at the downstream position to remove the above-mentioned loosened toner or deposition.

Thereafter, the toner images transferred to the intermediate transfer belt 21, which becomes one full color image, is transferred to recording paper synchronizedly fed between the intermediate transfer belt and a secondary transfer roller 25 to which the predetermined bias is applied. The transfer device 20 includes a primary transfer roller 23, a secondary transfer roller 25, an intermediate transfer belt 21, an intermediate transfer belt-cleaning device 22, etc.

Moreover, selected recording paper is fed one by one from a paper feeding cassette 40 from a plurality of the paper feeding cassettes 40 disposed inside a paper feeder 2 by a pick-up roller 42 controlled by the image forming apparatus 1. Then, the recording paper is transported to the image forming unit 3 by a transport roller 43. Then, the recording paper is fed towards a secondary transfer roller 25 by a registration roller 44 synchronizedly with the toner image on the intermediate transfer belt 21.

Thereafter, the recording paper, on which the toner image is transferred, is transported to the fixing device 50, followed by heating and pressing the recording paper to fix the toner image on the recording paper to thereby output a full color image.

In the case where printing is performed on both sides of the sheet, the recording paper is returned to the double-side conveyance unit 32 before the recording paper is sent to the paper ejection tray 48 from the image fixing device. Then, the recording paper is again sent to the registration roller 44 and printing is performed on the second surface.

In the developing device 13, a developing sleeve including a magnetic field generating unit therein is disposed at a position facing the photoconductor 11. The charging device 12 is configured to apply predetermined voltage from a power source with a charging roller, which is a charging member disposed to face the photoconductor 11, in a contact or non-contact state, to uniformly charge a surface of the photoconductor 11.

Moreover, the cleaning device 19 includes a cleaning blade for the photoconductor 11. Furthermore, the cleaning device includes a collecting blade of film configured to collect the cleaned toner and a collection coil configured to transfer the toner. The cleaning blade is formed of a material, such as a metal, a resin, and rubber. As the material of the cleaning blade, rubber, such as silicone rubber, butyl rubber, butadiene rubber, isoprene rubber, and urethane rubber, is preferable used. Among the above-listed example, urethane rubber is particularly preferable.

In addition to the devices mentioned above, a lubricant applicator configured to apply a lubricant, such as a resin (e.g., a fluororesin and a silicone resin) and a stearic acid metal compound (e.g., zinc stearate and aluminium stearate) onto the photoconductor 11 may be disposed. In FIG. 1, 24 is a conveyance belt and 47 is an ejection roller.

Note that, in FIG. 1, the image formation station 10 used in the image forming apparatus of the present disclosure can also function as a process cartridge.

Figure 2:
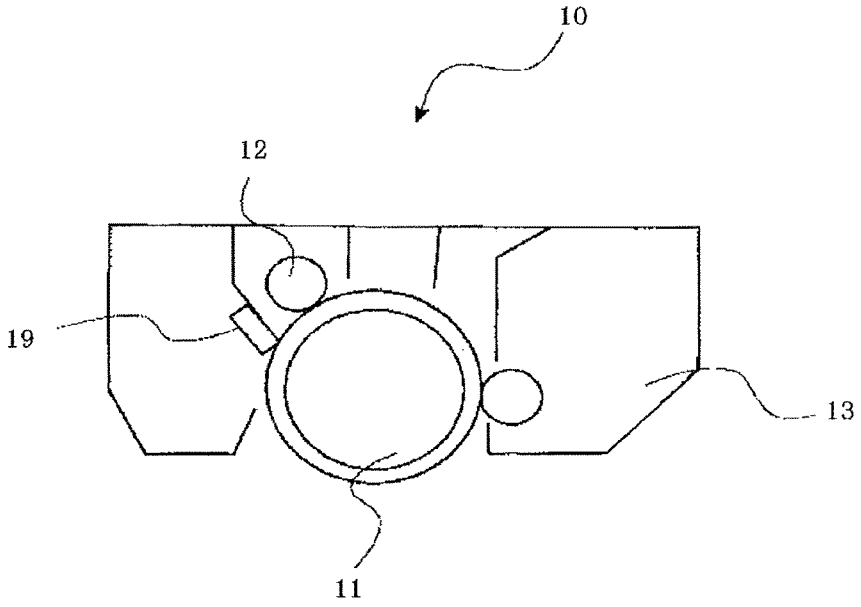
FIG. 2 is a schematic view illustrating one example of a process cartridge of the present disclosure.

FIG. 2 is a schematic view illustrating one example of a structure of the process cartridge of the present disclosure. As illustrated in FIG. 2, the process cartridge 10 includes a charging device 12, a developing device 13, and a cleaning device 19 all of which are disposed at the periphery of a photoconductor 11. The process cartridge 10 is not particularly limited as long as the process cartridge includes at least the photoconductor 11 and other process devices. A latent image is formed on the photoconductor 11 by laser light L emitted from an exposing device 30 disposed at the upper area. The process cartridge 10 is detachably mounted in a main body of an image forming apparatus, such as a copier and a printer.

EXAMPLES

Examples of the present disclosure will be described below. However, the present disclosure should not be construed as being limited to the Examples. Note that, "part(s)" denotes "part(s) by mass."

<Production Example of Core>

Core Production Example 1

Powders of $MnCO_3$, $Mg(OH)_2$, and $Fe_2O_3$ were weighed and mixed to obtain a powder mixture. The powder mixture was prebaked by a heating furnace in the atmosphere for 3 hours at 900° C. After cooling the obtained prebaked product, the prebaked product was pulverized to obtain a powder having a particle size of about 7 μm. The resultant powder was added to water together with a 1% by mass dispersant to thereby prepare slurry. The slurry was provided to a spray drier to granulate to thereby obtain granules having an average particle diameter of about 40 μm. A firing furnace was loaded with the granules, and the granules were baked in a nitrogen atmosphere for 5 hours at 1,250° C. The obtained fired product was ground by a grinder, followed by adjusting a particle size through sieving, to thereby obtain spherical ferrite particles C1 having a volume average particle diameter of about 35 μm.

The volume average particle diameter was measured in water by means of a Mictotrac particle size distribution meter model HRA9320-X100 (available from NIKKISO CO., LTD.) with setting a material refractive index to 2.42, a solvent refractive index to 1.33, and a concentration to about 0.06.

Resin Synthesis Example

Resin Synthesis Example 1

A flask equipped with a stirrer was charged with 300 g of toluene, and the toluene was heated up to 90° C. under nitrogen gas flow. To the resultant toluene, subsequently, a mixture containing 84.4 g of 3-methacryloxypropyltris(trimethylsiloxy)silane represented by $CH_2{=}CMe\text{-}COO{-}C_3H_6{-}Si(OSiMe_3)_3$ (in the formula, Me is a methyl group) (200 mmol, Silaplane TM-0701T, available from CHISSO CORPORATION), 39 g (150 mmol) of 3-methacryloxypropylmethyldiethoxysilane, 65.0 g (650 mmol) of methyl methacrylate, and 0.58 g (3 mmol) of 2,2'-azobis-2-methylbutyronitrile was added by dripping for 1 hour. After completing the dripping, a solution prepared by dissolving 0.06 g (0.3 mmol) of 2,2'-azobis-2-methylbutyronitrile in 15 g of toluene was further added (a total amount of 2,2'-azobis-2-methylbutyronitrile: 0.64 g (3.3 mmol)) and the resultant was mixed for 3 hours at a temperature of from 90° C. through 100° C. to thereby obtain Methacryl-Based Copolymer 1.

A weight average molecular weight of the obtained methacryl-based copolymer was 33,000. Subsequently, the methacryl-based copolymer was diluted with toluene in a manner that a non-volatile component of the methacryl-based copolymer solution was to be 24% by mass.

The copolymer solution obtained in the above-mentioned manner had a viscosity of 8.8 $mm^2/s$ and specific gravity of 0.91.

Note that, the weight average molecular weight was determined by standard polystyrene conversion using gel permeation chromatography. The viscosity was measured at 25° C. according to JIS-K2283. Moreover, the non-volatile component was determined by weighing a coating agent composition on an aluminium plate by 1 g, heating the coating agent composition for 1 hour at 150° C., followed by measuring a mass of the coating agent composition, and then calculating a non-volatile component according to the following formula.

$$\text{Non-volatile component (\%)} = \text{mass after heating} \times 100/\text{mass before heating}$$

<Production Example of Toner>

[Toner 1]

—Synthesis of Polyester Resin A—

A reaction tank equipped with a cooling tube, a stirrer, and a nitrogen-inlet tube was charged with 65 parts of a bisphenol A ethylene oxide (2 mol) adduct, 86 parts of a bisphenol A propylene oxide (3 mol) adduct, 274 parts of terephthalic acid, and 2 parts of dibutyl tin oxide, and is the resultant mixture was allowed to react for 15 hours at 230° C. under ordinary pressure. Next, the resultant was reacted for 6 hours under the reduced pressure of from 5 mmHg through 10 mmHg to synthesize a polyester resin. Polyester resin A obtained had a number average molecular weight (Mn) of 2,300, a weight average molecular weight (Mw) of 8,000, glass transition temperature (Tg) of 58° C., an acid value of 25 mgKOH/g, and a hydroxyl value of 35 mgKOH/g.

—Synthesis of Prepolymer (Polymer Reactable with Active Hydrogen Group-containing Compound)—

A reaction vessel equipped with a cooling tube, a stirrer, and a nitrogen-inlet tube was charged with 682 parts of a bisphenol A ethylene oxide (2 mol) adduct, 81 parts of a bisphenol A propylene oxide (2 mol) adduct, 283 parts of terephthalic acid, 22 parts of trimellitic anhydride, and 2 parts of dibutyl tin oxide. The resultant mixture was allowed to react for 8 hours at 230° C. under ordinary pressure. Subsequently, the resultant was reacted for 5 hours under the reduced pressure of from 10 mmHg through 15 mHg to synthesize intermediate polyester.

The obtained intermediate polyester had a number average molecular weight (Mn) of 2,100, a weight average molecular weight (Mw) of 9,600, glass transition temperature (Tg) of 55° C., an acid value of 0.5, and a hydroxyl value of 49.

Next, a reaction vessel equipped with a cooling tube, a stirrer, and a nitrogen-inlet tube was charged with 411 parts of the intermediate polyester, 89 parts of isophorone diisocyanate, and 500 parts of ethyl acetate, and the resultant mixture was allowed to react for 5 hours at is 100° C. to synthesize a prepolymer (a polymer reactable with an active hydrogen group-containing compound).

An amount of free isocyanate of the obtained prepolymer was 1.60% by mass and a solid content of the prepolymer (after leaving to stand for 45 minutes at 150° C.) was 50% by mass.

—Synthesis of Ketimine (Active Hydrogen Group-containing Compound)—

A reaction vessel set with a stirring rod and a thermometer was charged with 30 parts of isophorone diamine and 70 parts of methyl ethyl ketone. The resultant mixture was allowed to react for 5 hours at 50° C. to synthesize a ketimine compound (an active hydrogen group-containing compound). The obtained ketimine compound (the active hydrogen group-containing compound) had an amine value of 423.

—Production of Master Batch—

By means of HENSCHEL MIXER (available from NIPPON COKE & ENGINEERING CO., LTD.), 1,000 parts of water, 540 parts of carbon black Printex35 (available from Degussa AG) having DBP oil absorption of 42 mL/100 g and pH of 9.5, and 1,200 parts of Polyester Resin A were mixed. The obtained mixture was kneaded by means of two rolls for 30 minutes at 150° C., followed by rolling and cooling the kneaded product. The resultant was pulverized by means of a pulverizer (available from HOSOKAWA MICRON CORPORATION).

—Preparation of Aqueous Medium—

Ion-exchanged water (306 parts), 265 parts of a 10% by mass tricalcium phosphate suspension liquid, and 1.0 part of sodium dodecylbenzenesulfonate were mixed and stirred to homogeneously dissolve to thereby prepare an aqueous medium.

—Measurement of Critical Micelle Concentration—

A critical micelle concentration of a surfactant was measured by the following method. By means of a surface tensiometer Sigma (available from KSV Instruments), an analysis was performed using an analysis program installed in the Sigma system. The surfactant was dripped in an amount of 0.01% by mass per drop to the aqueous medium and the mixture was stirred. After leaving to stand, a surface tension was measured. The surfactant concentration at which the surface tension stopped decreasing by the dripping of the surfactant was calculated as a critical micelle concentration from the obtained surface tension curve. A critical micelle concentration of sodium dodecylbenzenesulfonate to the aqueous medium was measured by the surface tensiometer Sigma. As a result, the critical micelle concentration was 0.05% by mass relative to the mass of the aqueous medium.

—Preparation of Toner Material Solution—

A beaker was charged with 70 parts of Polyester Resin A, 10 parts of the prepolymer, and 100 parts of ethyl acetate and the resultant mixture was stirred and dissolved. To the resultant, 5 parts of paraffin wax (HNP-9 available from NIPPON SEIRO CO., LTD., melting point: 75° C.) as a release agent, 2 parts of MEK-ST (available from NISSAN CHEMICAL INDUSTRIES, LTD.), and 10 parts of the master batch were dispersed by passing through a bead mill, Ultraviscomill (available from IMEX Co., Ltd.) 3 times under conditions that a feeding speed was 1 kg/h, a rim speed of a disk was 6 m/sec, zirconium beads having a particle diameter of 0.5 mm were packed at 80 vol %. Thereafter, 2.7 parts by mass of the ketimine compound was added to the resultant and dissolved, to thereby prepare a toner material solution.

—Preparation of Emulsion or Dispersion Liquid—

A vessel was charged with 150 parts of the aqueous medium phase and the aqueous medium phase was stirred at the revolution speed of 12,000 rpm by a TK homomixer (available from PRIMIX Corporation). To the aqueous medium phase, 100 parts of the toner material solution was added and the resultant mixture was mixed for 10 minutes to prepare an emulsion or dispersion liquid (emulsified slurry).

—Removal of Organic Solvent—

A flask set with a stirrer and a thermometer was charged with 100 parts of the emulsified slurry. With stirring the emulsified slurry at the stirring peripheral speed of 20 m/min, the solvent was removed from the emulsified slurry for 12 hours at 30° C. to thereby obtain a dispersion slurry.

—Washing—

The dispersion slurry (100 parts) was filtered under the reduced pressure to obtain a filtration cake. To the filtration cake, 100 parts of ion-exchanged water was then added and the resultant was mixed by means of a TK homomixer (for 10 minutes at the revolution speed of 12,000 rpm) followed by performing filtration. To the obtained filtration cake, 300 parts of ion-exchanged water was added and the resultant was mixed by the TK homomixer (for 10 minutes at the revolution speed of 12,000 rpm) followed by performing filtration, a series of the processes of which was performed twice. To the obtained filtration cake, 20 parts of a 10% by mass sodium hydroxide aqueous solution was added and the resultant was mixed by the TK homomixer (for 30 minutes at the revolution speed of 12,000 rpm) followed by performing filtration under the reduced pressure. To the obtained filtration cake, 300 parts of ion-exchanged water was added and the resultant was mixed by the TK homomixer (for 10 minutes at the revolution speed of 12,000 rpm). To the obtained filtration cake, 300 parts of ion-exchanged water was added and the resultant was mixed by the TK homomixer (for 10 minutes at the revolution speed of 12,000 rpm) followed by performing filtration, a series of the processes of which was performed twice. To the obtained filtration cake, 20 parts of 10% by mass hydrochloric acid was further added and the resultant was mixed by the TK homomixer (for 10 minutes at the revolution speed of 12,000 rpm) followed by performing filtration.

—Adjustment of Amount of Surfactant—

When 300 parts of ion-exchanged water was added to the filtration cake obtained by the washing above and the resultant mixture was mixed by the TK homomixer (for 10 minutes at the revolution speed of 12,000 rpm), electrical conductivity of the toner dispersion liquid was measured. A surfactant concentration of the toner dispersion liquid was calculated from the calibration curve of the surfactant concentration prepared in advance. From the calculated value, ion-exchanged water was added to adjust the surfactant concentration to the target surfactant concentration that was 0.05% by mass, to thereby obtain a toner dispersion liquid.

—Surface Treatment Step—

With mixing the toner dispersion liquid which had been adjusted to have the predetermined surfactant concentration by the TK homomixer at 5,000 rpm, the toner dispersion liquid was heated in a water bath for 10 hours at the heating temperature T1 of 55° C. Thereafter, the toner dispersion liquid was cooled to 25° C. and the resultant was subjected to filtration. To the obtained filtration cake, 300 parts of ion-exchanged water was further added and the resultant was mixed by the TK homomixer (for 10 minutes at the revolution speed of 12,000 rpm) followed by performing filtration.

—Drying—

The obtained final filtration cake was dried by an air circulation dryer for 48 hours at 45° C. and the resultant was sieved through a mesh having an opening size of 75 μm to thereby obtain Toner Base Particles 1.

—External Additive Treatment—

To 100 parts of Toner Base Particles 1, moreover, 3.0 parts of hydrophobic silica having an average particle diameter of 100 nm, 0.5 part by mass of titanium oxide having an average particle diameter of 20 nm, and 1.5 parts of a hydrophobic silica fine powder having an average particle diameter of 15 nm were added and mixed by HENSCHEL MIXER to thereby obtain [Toner 1].

[Toner 1] had the volume average particle diameter of 5.2 μm.

[Toner 2]

[Production of Pulverized Toner]

Crystalline polyester resin: 4 parts

Amorphous Resin 1: 35 parts

Amorphous Resin 2: 55 parts

Composite resin: 10 parts

Colorant (carbon black): 14 parts

Release agent (carnauba wax) (melting point: 81° C.): 6 parts

Charge-controlling agent (monoazo metal complex salt dye (BONTRON

S-34 ORIENT CHEMICAL INDUSTRIES CO., LTD.): 2 parts

After preliminary mixing the above-mentioned toner raw materials by means of HENSCHEL MIXER (FM20B, available from NIPPON COLE & ENGINEERING CO., LTD.), the resultant mixture was melted and kneaded at a temperature of from 100° C. through 130° C. by means of a twin-screw kneader (PCM-30, available from Ikegai Corp). After rolling the obtained kneaded product into a thickness of 2.8 mm by a roller, the resultant was cooled to room temperature by a belt cooler and was roughly pulverized into a size of from 200 μm through 300 μm by a hummer mill. After finely pulverizing the resultant by means of a supersonic jet mill Lab Jet (available from Nippon Pneumatic Mfg. Co., Ltd.), the resultant was classified by means of an air classifier (MDS-I, available from Nippon Pneumatic Mfg. Co., Ltd.) by appropriately adjusting the opening degree of a louver in a manner that a weight average particle diameter was to be 5.6 μm±0.2 μm, to thereby obtain toner base particles. Into 100 parts of the toner base particles, subsequently, 1.0 part of additive (HDK-2000, available from CLARIANT) were mixed, and the resultant mixture was stirred by means of HENSCHEL MIXER, to thereby obtain a pulverized toner [Toner 2].

The crystalline polyester was a resin obtained by using a 1,5-pentandiol compound as an alcohol component and a fumaric compound as a carboxylic acid component.

Specifically, monomers of the alcohol component and the carboxylic acid component were allowed to react through the esterification reaction with no catalyst at a temperature of from 170° C. through 260° C. under normal pressure. To the reaction system, thereafter, 400 ppm of antimony trioxide relative to the entire carboxylic acid component was added, and polycondensation was performed at 250° C. while removing glycol out from the system under vacuum of 3 Torr, to thereby obtain a crystalline resin. Note that, the crosslinking reaction was performed until the stirring torque was to be 10 kg·cm (100 ppm) and the reaction was terminated by releasing the decompressed state of the reaction system.

TABLE 1

| Crystalline polyester | | | | |
|---|---|---|---|---|
| Glass transition temperature Tg [° C.] | Softening point T½ [° C.] | Presence of ester bond of General Formula (1) | Alcohol component | Carboxylic acid component |
| 98 | 104 | Not present | 1,5-pentanediol | Fumaric acid |

Figure 3:
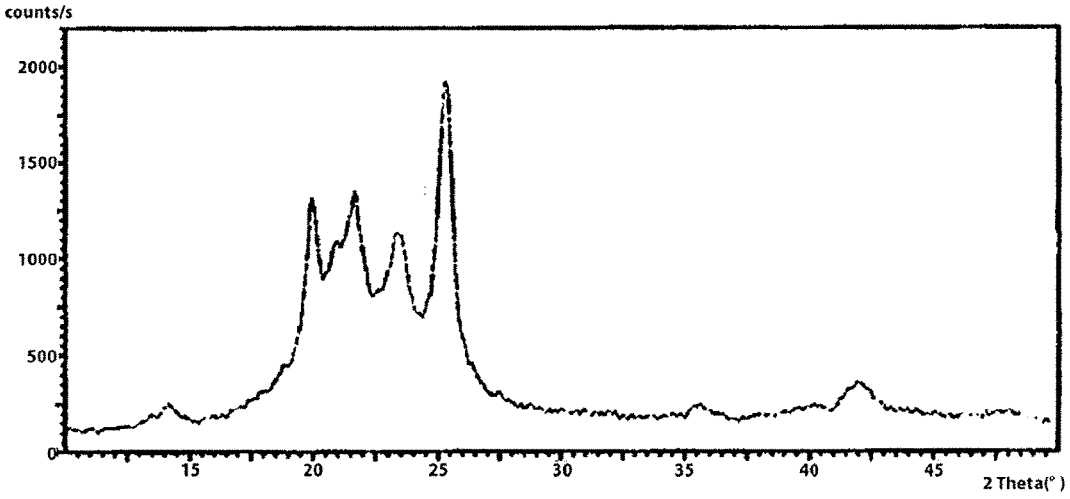
FIG. 3 is an X-ray diffraction spectrum of a crystalline polyester resin produced in Example.

Moreover, at least one diffraction peak was present at the position of 2θ=from 19° through 25° in the X-ray diffraction pattern of the crystalline polyester resin measured by a powder X-ray diffraction device and the crystalline polyester resin above was confirmed as crystalline polyester. The result of the X-ray diffraction of the crystalline polyester resin is presented in FIG. 3.

Amorphous Resins 1 and 2 above are resins obtained in the following manner.

Monomers of an aromatic diol component, ethylene glycol, and terephthalic acid or isophthalic acid were allowed to react through the esterification reaction with no catalyst at a temperature of from 170° C. through 260° C. under normal pressure. To the reaction system, thereafter, 400 ppm of antimony trioxide relative to the entire carboxylic acid component was added, and polycondensation was performed at 250° C. while removing glycol out from the system under vacuum of 3 Torr, to thereby obtain a resin. Note that, the crosslinking reaction was performed until the stirring torque was to be 10 kg-cm (100 ppm) and the reaction was terminated by releasing the decompressed state of the reaction system.

There was no diffraction peak present in the X-ray diffraction patterns of Amorphous Resins 1 and 2 above and Amorphous Resins 1 and 2 were confirmed as being amorphous.

TABLE 2

| Amorphous Resin 1 | | | | |
|---|---|---|---|---|
| Material | Softening point T½ [° C.] | Chloroform-insoluble component [wt %] | Acid component | Alcohol component |
| Polyester | 140 | 21 | Fumaric acid<br>Trimellitic anhydride | Bisphenol A (2,2) propylene oxide<br>Bisphenol A (2,2) ethylene oxide |

TABLE 3

| Amorphous Resin 2 | | | | | | |
|---|---|---|---|---|---|---|
| | | Glass | Molecular weight distribution | | | |
| Material | Softening point T½ | transition temperature Tg [° C.] | Main peak | Half value width | Acid component | Alcohol component |
| Polyester | 89 | 62 | 4,000 | 13,000 | Terephthalic acid<br>Dodecenyl succinic anhydride<br>Trimellitic anhydride | Bisphenol A (2,2) propylene oxide<br>Bisphenol A (2,2) ethylene oxide |

The composite resin is a resin obtained in the following manner.

A 4-necked flask, which was a 5 L container and was equipped with a nitrogen inlet tube, a dehydration tube, a stirrer, a dripping funnel, and a thermocouple was charged with polycondensation-based monomers, i.e., 0.8 mol of terephthalic acid, 0.6 mol of fumaric acid, 0.8 mol of trimellitic anhydride, 1.1 mol of bisphenol A (2,2) propylene oxide, and 0.5 mol of bisphenol A (2,2) ethylene oxide, and an esterification catalyst, i.e., 9.5 mol of dibutyl tin oxide. The resultant mixture was heated to 135° C. in a nitrogen atmosphere.

With stirring, addition polymerization-based monomers, i.e., 10.5 mol of styrene, 3 mol of acrylic acid, and 1.5 mol of 2-ethylhexylacrylate, and a polymerization initiator, i.e., 0.24 mol of t-butylhydroperoxide were placed in the dripping funnel, and the resultant mixture was dripped for 5 hours to perform a reaction for 6 hours.

Subsequently, the resultant was heated up to 210° C. for 3 hours, and a reaction was performed at 210° C. and 10 kPa until a desired softening point was obtained, to thereby synthesize a composite resin.

The obtained composite resin had a softening point of 115° C., a glass transition temperature of 58° C., and an acid value of 25 mgKOH/g.

TABLE 4

| Composite resin | |
|---|---|
| Polycondensation-based unit | Addition polymerization-based unit |
| Polyester-based | Vinyl-based |

Production examples of a carrier and a production method of a developer will be described below.

Example 1

Methacryl-Based Copolymer 1 [solid content: 24% by mass]: 22.0 parts

Silicone resin solution [solid content: 41% by mass] (SR2410, available from Dow Corning Toray Co., Ltd.): 220.0 parts Titanium catalyst [solid content: 57% by mass] (TC-754, available from Matsumoto Fine Chemical Co., Ltd.): 23.2 parts Aminosilane [solid content: 100% by mass] (SH6020, Dow Corning Toray Co., Ltd.): 1.8 parts Barium sulfate particles (volume average particle diameter D50: 740 nm): 126 parts Oxygen-deficient tungsten-doped tin particles (volume average particle diameter D50: 250 nm): 165.6 parts Octane: 1,300 parts The raw materials excluding the titanium catalyst were blended and the resultant mixture was dispersed together with 1,000 parts of 0.5 mm Zr beads by a paint shaker. Thereafter, the beads were removed by a mesh, and the resultant was left to stand for 10 minutes to thereby obtain a resin coating film forming solution. As a core, 5,000 parts of spherical ferrite particles C1 (true specific gravity: 5.5) having an average particle diameter of 35 μm were used. Surfaces of the core particles were coated with a solution prepared by adding the titanium catalyst to the coating film forming solution by means of SPIRA COTA (available from OKADA SEIKO CO., LTD.) at an internal coater temperature of 70° C. After completing the coating, the resultant was dried for 20 minutes at 70° C. that was the same temperature to the temperature during the coating.

The obtained carrier was left in an electric furnace in a nitrogen atmosphere for 1 hour at 210° C. to fire the carrier. After cooling the resultant, the ferrite powder bulks were ground using a sieve having an opening size of 63 μm to thereby obtain [Carrier 1].

The exposed amount B of the barium of [Carrier 1] was 4.1 (atomic %).

[Carrier 1] and [Toner 1] were weighed in a manner that a toner density was to be 7 wt %, and the mixture was stirred for 5 minutes at 81 rpm by means of a turbula mixer, to thereby produce [Developer 1] that was a developer for evaluation.

Comparative Example 1

[Carrier 2] and [Developer 2] were obtained in the same manner as in Carrier 1 of Example 1, except that the drying time was changed to 0 minutes. The exposed amount B of the barium of [Carrier 2] was 0.1 is (atomic %).

Example 2

[Carrier 3] and [Developer 3] were obtained in the same manner as in Carrier 1 of Example 1, except that the amount of the barium sulfate particles (volume average particle diameter D50: 740 nm) was changed to 90.0 parts, the amount of the oxygen-deficient tungsten-doped tin particles (volume average particle diameter D50: 250 nm) was changed to 165.6 parts, and the drying time was changed to 7 minutes. The exposed amount B of the barium of [Carrier 3] was 1.2 (atomic %).

Example 3

[Carrier 4] and [Developer 4] were obtained in the same manner as in Carrier 1 of Example 1, except that the amount of the barium sulfate particles (volume average particle diameter D50: 740 nm) was changed to 300.0 parts, the amount of the oxygen-deficient tungsten-doped tin particles (volume average particle diameter D50: 250 nm) was changed to 300.0 parts, and the drying time was changed to 30 minutes. The exposed amount B of the barium of [Carrier 4] was 9.9 (atomic %).

Comparative Example 2

[Carrier 5] and [Developer 5] were obtained in the same manner as in Carrier 1 of Example 1, except that the amount of the barium sulfate particles (volume average particle diameter D50: 740 nm) was changed to 80.0 parts, the amount of the oxygen-deficient tungsten-doped tin particles (volume average particle diameter D50: 250 nm) was changed to 165.5 parts, and the drying time was changed to 7 minutes. The exposed amount B of the barium of [Carrier 5] was 1.1 (atomic %).

Comparative Example 3

[Carrier 6] and [Developer 6] were obtained in the same manner as in Carrier 1 of Example 1, except that the amount of the barium sulfate particles (volume average particle diameter D50: 740 nm) was changed to 300.0 parts, the amount of the oxygen-deficient tungsten-doped tin particles (volume average particle diameter D50: 250 nm) was changed to 300.0 parts, and the drying time was changed to 35 minutes. The exposed amount B of the barium of [Carrier 6] was 10.8 (atomic %).

Example 4

[Carrier 7] and [Developer 7] were obtained in the same manner as in Carrier 1 of Example 1, except that the amount of the barium sulfate particles (volume average particle diameter D50: 740 nm) was changed to 110.0 parts, the amount of the oxygen-deficient tungsten-doped tin particles (volume average particle diameter D50: 250 nm) was changed to 165.5 parts, and the drying time was changed to 15 minutes. The exposed amount B of the barium of [Carrier 7] was 3.0 (atomic %).

Example 5

[Carrier 8] and [Developer 8] were obtained in the same manner as in Carrier 1 of Example 1, except that the amount of the barium sulfate particles (volume average particle diameter D50: 740 nm) was changed to 250.0 parts, the amount of the oxygen-deficient tungsten-doped tin particles (volume average particle diameter D50: 250 nm) was changed to 250.0 parts, and the drying time was changed to 30 minutes. The exposed amount B of the barium of [Carrier 8] was 8.0 (atomic %).

Example 6

[Carrier 9] and [Developer 9] were obtained in the same manner as in Carrier 1 of Example 1, except that the amount of the barium sulfate particles (volume average particle diameter D50: 740 nm) was changed to 103.0 parts, the amount of the oxygen-deficient tungsten-doped tin particles (volume average particle diameter D50: 250 nm) was changed to 165.5 parts, and the drying time was changed to 13 minutes. The exposed amount B of the barium of [Carrier 9] was 2.8 (atomic %).

Example 7

[Carrier 10] and [Developer 10] were obtained in the same manner as in Carrier 1 of Example 1, except that the amount of the barium sulfate particles (volume average particle diameter D50: 740 nm) was changed to 270.0 parts, the amount of the oxygen-deficient tungsten-doped tin particles (volume average particle diameter D50: 250 nm) was changed to 250.0 parts, and the drying time was changed to 31 minutes. The exposed amount B of the barium of [Carrier 10] was 8.4 (atomic %).

Example 8

[Carrier 11] and [Developer 11] were obtained in the same manner as in Carrier 1 of Example 1, except that the barium sulfate particles were changed to magnesium hydroxide (volume average particle diameter D50: 800 nm). The exposed amount B of the magnesium of [Carrier 11] was 4.3 (atomic %).

Example 9

[Carrier 12] and [Developer 12] were obtained in the same manner as in Carrier 1 of Example 1, except that D50 of the barium sulfate particles was changed from 740 nm to 500 nm. The exposed amount B of the barium of [Carrier 12] was 4.0 (atomic %).

Example 10

[Carrier 13] and [Developer 13] were obtained in the same manner as in Carrier 1 of Example 1, except that D50 of the barium sulfate particles was changed from 740 nm to 1,000 nm. The exposed amount B of the barium of [Carrier 13] was 4.1 (atomic %).

Example 11

[Carrier 14] and [Developer 14] were obtained in the same manner as in Carrier 1 of Example 1, except that D50 of the barium sulfate particles was changed from 740 nm to 489 nm. The exposed amount B of the barium of [Carrier 14] was 4.2 (atomic %).

Example 12

[Carrier 15] and [Developer 15] were obtained in the same manner as in Carrier 1 of Example 1, except that D50 of the barium sulfate particles was changed from 740 nm to 1,030 nm. The exposed amount B of the barium of [Carrier 15] was 4.1 (atomic %).

Example 13

[Developer 16] was obtained in the same manner as in Example 1, except that the toner to be mixed with [Carrier 1] was changed from [Toner 1] to [Toner 2].

Methods for evaluations of the obtained developers by actual devices will be described below.

<Evaluation of Carrier Deposition (Solid Area)>

An image evaluation was performed using the obtained developer and RICOH Pro C9110 (on-demand printer available from Ricoh Company Limited) which was a high-speed machine. After printing on 600,000 sheets in the A4-size with an imaging area of 0.5% using each of Developers 1 to 6 of Examples and Comparative Examples, the evaluation was performed under the following conditions.

When carrier deposition occurs, the carrier deposition causes damages on a photoconductor drum or a fixing roller, leading to low image quality. Even through the carrier deposition occurs on the photoconductor, only part of the carrier is transferred onto paper. Accordingly, the evaluation was performed by the following method.

After printing 600,000 sheets, image formation was suspended by a method where a power source was turned off during image formation of a solid image performed under certain developing conditions (charging potential (Vd): −600 V, potential of an area corresponding to an image area (solid document) after photosensitization: −100 V, developing bias: DC −500 V). The number of carrier deposition occurred on the photoconductor after transferring was counted to perform evaluation. Note that, the region to be evaluated was a region in the size of 10 mm×100 mm on the photoconductor. "A" was a state where the number of carrier deposition occurred was 0, "B" was a state where the number of carrier deposition occurred was from 1 through 2, "C" was a state where the number of carrier deposition occurred was from 3 through 4, and "D" was a state where the number of carrier deposition occurred was 5 or more. It was determined that "A," "B," and "C" were acceptable and "D" was unacceptable.

<Evaluations of Toner Scattering 1 and 2>

An image evaluation was performed using the obtained developer and RICOH Pro C6003 (a digital color copier/printer multifunction peripheral, available from Ricoh Company Limited).

Toner scattering 1 was evaluated by, after printing 600,000 sheets in the A4-size using each of Developers 1 to 16 of Examples and Comparative Examples with an imaging area rate of 5%, visually observing a state of a side surface of the developing unit. In the table, A was very good, B was good, C was usable, and D was poor.

"A" was a state where there was no toner scattering occurred in the entire PCU unit. "B" was a state where the developing unit was smeared with the toner, but the toner was not scattered outside the device, "C" was a state where the developing unit and the filter were smeared with the toner, but the toner was not scattered outside the device, and "D" was a state where the toner was scattered outside the device.

Toner scattering 2 was evaluated in the same manner as in toner scattering 1 except that the image area was changed to 20%.

After printing 600,000 sheets, a state of a side surface of the developing unit was visually observed to perform evaluation. The symbols in the table are the same as in toner scattering 1.

<ID Evaluation in 10° C. 15% Environment>

An image evaluation was performed using the obtained developer and RICOH Pro C9110 (on-demand printer available from Ricoh Company Limited). The temperature and humidity of the device and the developer were adjusted to 10° C. and 15%. After printing 100 sheets in the A4-size with an imaging area rate of 0.5%, a total solid image (imaging area rate: 100%) printed on 2 sheets, ID was measured at 5 positions per sheet, and an average value of the 2 sheets was calculated.

"A" was a case where ID was 1.6 or greater but less than 1.8, "B" was a case where ID was 1.4 or greater but less than 1.6, "C" was a case where ID was 1.2 or greater but less than 1.4, and "D" was a case where ID was less than 1.2. It was determined that "A," "B," and "C" were acceptable and "D" was unacceptable.

<Evaluation of Carrier Deposition on Edge Portions>

An image evaluation was performed using the obtained developer and RICOH Pro C9110 (on-demand printer available from Ricoh Company Limited). The temperature and humidity of the device and the developer were adjusted to 10° C. and 15%. After printing 100 sheets in the A4-size with an imaging area rate of 0.5%, an evaluation was performed under the following conditions.

When carrier deposition occurs, the carrier deposition causes damages on a photoconductor drum or a fixing roller, leading to low image quality.

After printing 100 sheets, an image of 2 dot-lines (100 lpi/inch) was formed on the photoconductor along the sub-scanning direction. Then, image formation was suspended by a method where a power source was turned off during image formation of the two-dot lines performed under certain developing conditions (charging potential (Vd): −600 V, potential of an area corresponding to an image area (solid document) after photosensitization: −100 V, developing bias: DC −400 V, transfer bias: 0 V). The number of carrier deposition on the photoconductor after transferring was counted to perform evaluation. Note that, the region to be evaluated was a region in the size of 10 mm×100 mm on the photoconductor. "A" was a state where the number of carrier deposition occurred was 0, "B" was a state where the number of carrier deposition occurred was from 1 through 8, "C" was a state where the number of carrier deposition occurred was from 9 through 20, and "D" was a state where the number of carrier deposition occurred was 21 or more. It was determined that "A," "B," and "C" were acceptable and "D" was unacceptable.

The evaluation results are presented in Table 5.

TABLE 5

| | | | | Exposed amount B | Particles 1 | | Particles 2 | |
|---|---|---|---|---|---|---|---|---|
| | Carrier | Toner | Developer | atomic % | Type | Parts | Type | Parts |
| Ex 1 | Carrier 1 | Toner 1 | Developer 1 | 4.1 | barium sulfate particles (D50: 740 nm) | 126.0 | oxygen-deficient tungsten-doped tin (D50: 250 nm) | 165.6 |
| Comp. Ex 1 | Carrier 2 | Toner 1 | Developer 2 | 0.1 | barium sulfate particles (D50: 740 nm) | 126.0 | oxygen-deficient tungsten-doped tin (D50: 250 nm) | 165.6 |

TABLE 5-continued

| | | | | | | | | |
|---|---|---|---|---|---|---|---|---|
| Ex 2 | Carrier 3 | Toner 1 | Developer 3 | 1.2 | barium sulfate particles (D50: 740 nm) | 90.0 | oxygen-deficient tungsten-doped tin (D50: 250 nm) | 165.6 |
| Ex 3 | Carrier 4 | Toner 1 | Developer 4 | 9.9 | barium sulfate particles (D50: 740 nm) | 300.0 | oxygen-deficient tungsten-doped tin (D50: 250 nm) | 300.0 |
| Comp. Ex 2 | Carrier 5 | Toner 1 | Developer 5 | 1.1 | barium sulfate particles (D50: 740 nm) | 80.0 | oxygen-deficient tungsten-doped tin (D50: 250 nm) | 165.6 |
| Comp. Ex 3 | Carrier 6 | Toner 1 | Developer 6 | 10.8 | barium sulfate particles (D50: 740 nm) | 300.0 | oxygen-deficient tungsten-doped tin (D50: 250 nm) | 300.0 |
| Ex 4 | Carrier 7 | Toner 1 | Developer 7 | 3.0 | barium sulfate particles (D50: 740 nm) | 110.0 | oxygen-deficient tungsten-doped tin (D50: 250 nm) | 165.6 |
| Ex 5 | Carrier 8 | Toner 1 | Developer 8 | 8.0 | barium sulfate particles (D50: 740 nm) | 250.0 | oxygen-deficient tungsten-doped tin (D50: 250 nm) | 250.0 |
| Ex 6 | Carrier 9 | Toner 1 | Developer 9 | 2.8 | barium sulfate particles (D50: 740 nm) | 103.0 | oxygen-deficient tungsten-doped tin (D50: 250 nm) | 165.6 |
| Ex 7 | Carrier 10 | Toner 1 | Developer 10 | 8.4 | barium sulfate particles (D50: 740 nm) | 270.0 | oxygen-deficient tungsten-doped tin (D50: 250 nm) | 250.0 |
| Ex 8 | Carrier 11 | Toner 1 | Developer 11 | 4.3 | magnesium hydroxide particles (D50: 800 nm) | 126.0 | oxygen-deficient tungsten-doped tin (D50: 250 nm) | 165.6 |
| Ex 9 | Carrier 12 | Toner 1 | Developer 12 | 4.0 | barium sulfate particles (D50: 500 nm) | 126.0 | oxygen-deficient tungsten-doped tin (D50: 250 nm) | 165.6 |
| Ex 10 | Carrier 13 | Toner 1 | Developer 13 | 4.1 | barium sulfate particles (D50: 1,000 nm) | 126.0 | oxygen-deficient tungsten-doped tin (D50: 250 nm) | 165.6 |
| Ex 11 | Carrier 14 | Toner 1 | Developer 14 | 4.2 | barium sulfate particles (D50: 489 nm) | 126.0 | oxygen-deficient tungsten-doped tin (D50: 250 nm) | 165.6 |
| Ex 12 | Carrier 15 | Toner 1 | Developer 15 | 4.1 | barium sulfate particles (D50: 1,030 nm) | 126.0 | oxygen-deficient tungsten-doped tin (D50: 250 nm) | 165.6 |
| Ex 13 | Carrier 1 | Toner 2 | Developer 16 | 4.1 | barium sulfate particles (D50: 740 nm) | 126.0 | oxygen-deficient tungsten-doped tin (D50: 250 nm) | 165.6 |

| | Drying time mins | Carrier film thickness μm | RICOH Pro C9110 0.5% image 600 kp Carrier deposition on solid image | RICOH MP C6003 5% image 600 kp Toner scattering 1 | RICOH MP C6003 20% image 600 kp Toner scattering 2 | RICOH Pro C9110 0.5% image 100 sheets ID reduction in 10° C. 15% environment | RICOH Pro C9110 0.5% image 100 sheets Carrier deposition on edge portions |
|---|---|---|---|---|---|---|---|
| Ex 1 | 20 | 0.3 | A | A | A | A | A |
| Comp. Ex 1 | 0 | 0.3 | D | C | D | A | A |
| Ex 2 | 7 | 0.3 | C | B | C | A | A |
| Ex 3 | 30 | 0.3 | B | A | A | C | B |
| Comp. Ex 2 | 7 | 0.3 | C | C | C | A | A |
| Comp. Ex 3 | 35 | 0.3 | C | A | A | C | C |
| Ex 4 | 15 | 0.3 | A | A | B | A | A |
| Ex 5 | 30 | 0.3 | B | A | A | B | B |
| Ex 6 | 13 | 0.3 | A | B | B | A | A |
| Ex 7 | 31 | 0.3 | B | A | A | C | B |
| Ex 8 | 20 | 0.3 | B | B | B | C | C |
| Ex 9 | 20 | 0.3 | B | B | B | A | A |
| Ex 10 | 20 | 0.3 | C | A | B | A | A |
| Ex 11 | 20 | 0.3 | B | C | C | A | A |
| Ex 12 | 20 | 0.3 | C | B | B | A | A |
| Ex 13 | 20 | 0.3 | B | A | B | A | A |

What is claimed is:

1. A carrier for a developer of an electrostatic latent image, the carrier comprising:

a core particle, and a resin layer covering the core particle, wherein the resin layer comprises metal compound particles, wherein the metal compound particles comprise tungsten-doped tin (WTO) and magnesium compound particles or barium compound particles, and an exposed amount B in atomic % of the magnesium or the barium on a surface of the carrier satisfies the following relationship:

$$10.0 \geq B \geq 1.2.$$

2. The carrier for a developer of an electrostatic latent image according to claim 1, wherein the exposed amount B in atomic % satisfies the following relationship:

$$8.0 \geq B \geq 3.0.$$

3. The carrier for a developer of an electrostatic latent image according to claim 1, wherein the metal compound particles comprise the barium compound particles.

4. The carrier for a developer of an electrostatic latent image according to claim 1, wherein the carrier satisfies the following relationship:

$$500 \leq C \leq 1{,}000,$$

wherein C in nm is a volume average particle diameter D50 of the magnesium compound particles or the barium compound particles.

5. A two-component developer comprising:

the carrier according to claim 1; and a toner.

6. An image forming apparatus comprising:

the two-component developer according to claim 5;

an electrostatic latent image bearer;

a charging unit configured to charge the electrostatic latent image bearer;

an exposing unit configured to form an electrostatic latent image on the electrostatic latent image bearer;

a developing unit configured to develop the electrostatic latent image formed on the electrostatic latent image bearer with the two-component developer to form a toner image;

a transferring unit configured to transfer the toner image formed on the electrostatic latent image bearer to a recording medium; and a fixing unit configured to fix the toner image transferred to the recording medium.

7. A toner stored unit comprising:

a unit; and the two-component developer according to claim 5 stored in the unit.

8. A replenishing developer comprising:

the carrier of claim 1; and a toner, wherein the replenishing developer comprises from 2 parts by mass to 50 parts by mass of the toner relative to 1 part by mass of the carrier.

9. A toner stored unit comprising:

a unit; and the replenishing developer according to claim 8 stored in the unit.

10. The carrier for a developer of an electrostatic latent image according to claim 1, wherein the metal compound particles comprise the magnesium compound particles.

11. The carrier for a developer of an electrostatic latent image according to claim 1, wherein an amount of the metal compound particles is from 50 parts by mass to 300 parts by mass relative to 100 parts by mass of the resin.

* * * * *